US005769608A

United States Patent [19]

Seale

[11] Patent Number: 5,769,608

[45] Date of Patent: Jun. 23, 1998

[54] RESONANT SYSTEM TO PUMP LIQUIDS, MEASURE VOLUME, AND DETECT BUBBLES

[75] Inventor: Joseph B. Seale, Gorham, Me.

[73] Assignee: P.D. Coop, Inc., Bedford, N.H.

[21] Appl. No.: 258,327

[22] Filed: Jun. 10, 1994

[51] Int. Cl.[6] ..... F04B 17/03

[52] U.S. Cl. ..... 417/53; 417/416; 417/413.1; 417/360

[58] Field of Search ..... 417/416, 360, 417/383, 385, 389, 395, 379, 413.1, 53; 137/843, 860; 251/900; 74/110

[56] References Cited

U.S. PATENT DOCUMENTS

| | | | |
|---|---|---|---|
| 1,556,059 | 10/1925 | Williams | 417/416 |
| 1,866,137 | 7/1932 | Tice | 417/416 |
| 2,023,799 | 12/1935 | Williams | 417/416 |
| 2,608,376 | 8/1952 | Adams | 251/900 |
| 2,735,368 | 2/1956 | Antonazzi | 417/379 |
| 3,029,743 | 4/1962 | Johns . | |
| 3,496,874 | 2/1970 | Findlay | 417/383 |
| 3,572,980 | 3/1971 | Hollyday . | |
| 4,152,098 | 5/1979 | Moody et al. . | |
| 4,265,600 | 5/1981 | Mandroian | 417/379 |
| 4,265,601 | 5/1981 | Mandroian . | |
| 4,482,346 | 11/1984 | Reinicke . | |
| 4,594,058 | 6/1986 | Fischell . | |
| 4,874,299 | 10/1989 | Lopez et al. . | |
| 4,939,405 | 7/1990 | Okuyama et al. . | |
| 5,085,562 | 2/1992 | Van Lintel . | |
| 5,094,594 | 3/1992 | Brennan . | |
| 5,106,274 | 4/1992 | Holtzapple | 417/383 |
| 5,249,932 | 10/1993 | Van Bork | 417/385 |
| 5,257,915 | 11/1993 | Laskaris et al. | 417/416 |
| 5,499,909 | 3/1996 | Yamada et al. | 417/413.1 |

FOREIGN PATENT DOCUMENTS

| | | | |
|---|---|---|---|
| 59-176480 | 10/1984 | Japan | 417/383 |
| 2029506 | 3/1980 | United Kingdom | 417/383 |
| 2265674A | 10/1993 | United Kingdom | 417/416 |

OTHER PUBLICATIONS

Technical Manual Entitled "Uttrasonic Motor" By The Electric Motor Division of Matsushita, Author Unknown, Date Unknown.

*Primary Examiner*—Timothy Thorpe
*Assistant Examiner*—Peter G. Korytnyk
*Attorney, Agent, or Firm*—Chris A. Caseiro; Thomas L. Bohan

[57] ABSTRACT

An electromechanical transducer drives a resonator plate, which develops oscillating pressure in a contacting liquid. A high-speed check valve rectifies the pressure oscillations, causing pumping. On the driver side of the valve, the high inertial flow impedance in a narrow passageway confines oscillating pressure while admitting non-oscillating fluid flow. On the valve side opposite the driver, a volumetric compliance element decouples the inertia of the fluid passageway to permit fast acceleration and deceleration of fluid pulsing through the valve. A high-speed passive check valve consists of a thin-section o-ring covering a circular slot, with circumferential tension setting the forward bias pressure. Pump frequencies above one kilohertz and microliter stroke volumes are practical. Electrical impedance measurements on the pump indicate fluid volume in the pump. A coupling of two pumps in series and an alternation of pumping and volume measurement operations in the coupled pumps leads to volumetric metering of fluid.

42 Claims, 6 Drawing Sheets

RESONANT SYSTEM TO PUMP LIQUIDS, MEASURE VOLUME, AND DETECT BUBBLES

CROSS-REFERENCE TO RELATED PATENT APPLICATION

This invention is related to the Joseph B. Seale U.S. patent application Ser. No. 08/258,198, filed Jun. 10, 1994, now U.S. Pat. No. 5,533,381 for LIQUID VOLUME, DENSITY, AND VISCOSITY TO FREQUENCY SIGNALS.

BACKGROUND OF THE INVENTION

1. Field of the Invention

The present invention relates to pumping fluids under tight volumetric control and, more particularly, it relates to a system and a method to generate audio-frequency AC fluid pressure in a resonant enclosure, to use a check valve for pumping, and to monitor DC pressures and volumes via perturbations in the resonance frequency of the enclosure.

2. Description of the Prior Art

Fluid pumps fall into two broad categories, positive displacement and dynamic. Positive displacement pumps capture a fluid in a cavity where internal volume varies, driving the pressure up or down and forcing the fluid to move. Positive displacement pumps generally rely on either check valves or moving fluid seals to maintain isolation between fluids at different pressures. Dynamic pumps use a combination of fluid inertia and fluid acceleration to generate a pressure gradient, causing the fluid pressure to be higher in one region than another, often without valves or seals intervening between regions of different pressure. Regions of high and low dynamic pressure are tapped to recover useful flow. Dynamic pumps are generally high-speed rotary pumps utilizing some combination of centrifugal and Bernoulli fluid forces, where the labels "centrifugal" and "Bernoulli" describe different approaches of analysis but not necessarily separate physical phenomena. A few non-rotary dynamic pumps use a "momentum piston" where a moving column of fluid is decelerated abruptly, with the resulting pressure gradient providing a transient pressure spike that drives a fluid pulse through a check valve to a region of higher pressure. The pump of the present invention shares properties of both positive displacement and dynamic pumps, looking like a dynamic pump to the physicist inquiring into operating principles, but looking like a positive displacement pump to the clinician, the lab scientist or robotics engineer seeking precise control of fluid volume displacement. The positive displacement and dynamic categories of pump in the prior art are discussed to place the present invention in context. The discussion explores a few key engineering principles known in the prior art but now taught as exploited in a novel and unexpected combination.

In positive displacement pumps, fluid flow may be regulated by active or passive valves or by moving seals. Volume delivery is regulated by rigid control of volume changes in the pump cavity. Any volume/pressure compliance of the pump cavity lends uncertainty to the volume delivered. Thus, rigid chambers with tight sliding seals, e.g., syringe pumps and variations on piston pumps, offer tighter volumetric control than flexible chambers, the latter relying on deformation rather than sliding seals to deliver fluid. It is frequently desired that wetted pump surfaces be sterilizable, hermetic, and disposable, so that a pumped fluid is not contaminated from the environment and does not mix with or contaminate a fluid to be pumped later. This requirement generates difficult tradeoffs between economy and rigid volumetric control. For example, a glass syringe offers excellent rigidity and precision of fit for efficient and very precise volumetric pumping, but the cost per syringe is incompatible with disposable use. Plastic syringes using elastomer seals offer better economy, but in order to insure against leakage, the seals are of necessity tight and impose high friction, causing a loss of efficiency for pumping, as is especially relevant in battery-operated devices. Tight sliding seals add difficulty to dispensing of very small volumetric increments, e.g., a few microliters, because seals exhibit high static friction. With a sliding seal "stuck," force on the piston accumulates until the seal slips abruptly, sometimes delivering a larger-than-desired bolus. Scaling the syringe down improves fine control but reduces volume capacity. Adding upstream and downstream check valves to make a reciprocating pump adds complexity and cost and brings into play questions of valve reliability, leakage, and compliance of elastic valve flaps causing uncertainty in estimating delivered volume.

An alternative positive displacement approach is to use a flexible chamber rather than sliding seals. The control issue is to achieve high flexibility in the cam or piston rod that controls fluid displacement, while simultaneously achieving very low volume/pressure compliance responsive to changes in the pressure of the pumped fluid. In other words, there should be just one mode in which the chamber expands or contracts in volume, and this mode should be dependent 100% on movement in the shaft that controls displacement. A good example of a disposable chamber design meeting these tradeoffs favorably is found in the device identified by the trademark RateMinder 5, manufactured by CRITIKON, Inc., which is designed with thick and fairly rigid panels meeting at living hinges that are required to flex only through small angles over a pump stroke. The volume per stroke of such a design is quite low, however, with the result that small volume/pressure compliances lead to significant fractional volume hysteresis between the pressure where an inlet check valve closes and the higher pressure where an outlet check valve opens.

Dynamic pumps dominate in most applications requiring high volume delivery and low-cost high fluid power. An exception is the area of hydraulic fluid power at very high pressures, where costly positive displacement designs continue to dominate. Dynamic pumps generally cannot be controlled very precisely, and they are both inefficient and uncontrollable for delivering small volumes. Dynamic pumps can be operated as unregulated pressure sources feeding independent flow regulation apparatus. Existing dynamic pump geometries do not lend themselves to design for disposable components in the fluid path.

An inherent advantage of dynamic pumps has been their direct use of high-RPM shaft power from electric motors. The physical constraints governing all forms of electric motors—specifically the maximum energy product available from permanent magnet materials, the saturation flux density of iron, and the resistivity of copper—dictate that efficient energy conversion in a compact device must entail a high frequency repetition of low-energy electromagnetic events such as stator poles passing by rotor poles. With this in mind, it is notable that positive displacement pumps, excepting rotary vane designs ill-adapted to precise volumetric control, generally require a reciprocating linear drive at low frequency and high energy per stroke. Direct drive by a reciprocating coil or solenoid is thus impractical for most positive displacement pumps. Some mechanical power transformation, e.g., down-gearing, must intervene between a motive source of electrical power and the positive displacement pump. Similar constraints apply to piezoelectric energy converters, where output per energy cycle and per unit mass is extremely low as dictated by the combined breakdown voltage and dielectric constant achievable in piezoelectric materials. Rotary piezoelectric motors have been designed to achieve relatively high torque and low RPM by having rapidly-vibrating disks "walk" rotationally along contacting fixed surfaces. (See, e.g., the Panasonic Technical Reference booklet "Ultrasonic Motor" by the Electric Motor Division of Matsushita Electric Ind. Co., Ltd. and available from Panasonic Industrial Co. at Two Panasonic Way Secaucus, N.J. 07094, 201-348-5200.) This effective vibrational down-gearing is achieved at a cost of mechanical complexity that has held these devices out of the mainstream motor market. The down-gearing and rotary-to-linear force conversion, via cam or piston rod, that is ubiquitous in positive displacement pumps, is significantly absent in dynamic pumps. It will be seen that the present invention shares this general ability of dynamic pumps to utilize high-frequency mechanical energy directly and efficiently.

OBJECTS OF THE PRESENT INVENTION

An object of the present invention is to create a dynamic fluid pump based on linear transduction of electric power and resonant vibration to generate an AC-pressure output and a valve-rectified pressure and flow output.

A further object of the invention is to utilize direct linear conversion of electric power in a vibrator that performs as the prime mover of a pump.

To achieve the frequencies and stroke amplitudes necessary for efficient linear power conversion in a lightweight vibration actuator, a further object is to utilize a mechanical/fluidic resonance to transform a low vibrational force into a high oscillatory fluid pressure, where the inertia of the resonance is primarily fluid and the spring restoration of the resonance resides in solid mechanical parts.

A further object is to utilize fluid inertia to confine fluid pressure vibration to the areas of pressure generation and AC-to-DC fluid power conversion, using a narrow passageway rather than an additional valve to prevent escape of motive AC pressure.

A further object is to use the incompressible nature of a working pump fluid to support a vibrating fluid transformer plate and create a smooth tapering of stress in the plate down to a low stress at the perimeter connection, thus minimizing stress localization and fatigue in a simple geometry.

Exploiting variable volume-dependent dynamic properties of a resonant pump, a further object is to measure mechanical resonant frequencies, as transformed into electrical resonances via the vibrator actuator, as indicators of fluid volume displacement within the pump and of the fluid pressure at the vibration driver side of the pump.

To transform high-frequency AC pressure into DC pressure and flow, an object of this invention is to provide a passive check valve opening and closing inertia is extremely low, and in which unwanted fluid inertia is decoupled from the valve area by inclusion of a compressible component.

Still a further object is to couple together two or more pump stages to permit increased pressure delivery and precise measurement of net delivered volume.

The significance and practical realization of these and other objects of the invention will be appreciated in the context of concrete examples in the following Specification, and more broadly in the claims.

SUMMARY OF THE INVENTION

Like a momentum-piston pump, the pump of the present invention develops pressure from the rapid acceleration and deceleration of fluid, but unlike other momentum-piston pumps, this acceleration is achieved in a resonant fashion through intimate coupling with an elastic metal cavity and an electromechanical transducer, permitting a continuous oscillatory transduction of electrical power to fluid power. Like a momentum-piston pump, the present pump uses a check valve to convert oscillatory pressure into DC pressure and DC flow. Prior art momentum-piston pumps have not utilized the range of high-frequency fluid phenomena harnessed by the present invention. One advantage of an oscillatory approach over a rotary approach is that oscillatory pumping can be started and stopped in a few milliseconds, whereas pumping based on an efficient high-RPM motor requires hundreds of milliseconds and a significant kinetic energy investment each time the pump is started. When the present oscillatory pump vibrates to move some fluid and then stops, the check valve is left closed and the volume moved is "positively displaced" and potentially subject to precise volumetric measurement. There is no rotary-shaft seal or any other seal besides the check valve. Oscillatory fluid power can be coupled into a hermetic disposable fluid path inexpensively.

It will be noted that the prior art in check valves does not offer a valve combining low cost, compatibility with disposable fluid sets, and speed sufficient to rectify kilohertz fluid flow efficiently. The scaling rules of viscosity associated with Reynolds numbers dictate a declining efficiency of rotary dynamic pumps with shrinking scale of fluid power. When fluid flow is vibrational rather than steady or rotary, however, the role of fluid inertia is increased as a function of frequency so that Reynolds numbers do not apply, and dynamic efficiency at high frequency and on a small scale of size and flow velocity greatly exceeds the efficiency possible in non-oscillatory dynamic pumps. Still further extension of efficiency to extremely low fluid power levels is achieved in the present invention through pulsed pumping operation over intervals down to a few milliseconds, in a time realm inaccessible to rotary pumps.

For applications of the present invention requiring tight servo control of output volume, two pump stages operate in series to generate and measure flow pulses. Volume and pressure measurements by the pump stages are based on measured vibrational dynamics of the actuation components, driven at low power levels, rather than at high power levels, to achieve linear response. Where output pressure rather than volume is to be servo-controlled, only a single pump stage is needed. No auxiliary sensors apart from the pump components themselves are used for these pressure and volume measurements. The rapidity with which the pump can start and stop pumping, and then measure what it has accomplished, makes it a strong candidate for fluid power in robotics and other high-control applications calling for a high-efficiency fluid- power counterpart to the electromechanical stepper motor. This combination of capabilities finds no parallel in the prior art.

The prime mover for the pump of the present invention is an electromechanical transducer functioning bidirectionally as a linear vibration driver and a velocity sensor. In a preferred embodiment, a moving-magnet driver/sensor provides vibration force in proportion to the current applied to a fixed driver winding, while a motion-sense winding simultaneously provides a voltage signal proportional to magnet velocity response. A pair of such driver/sensors, whose magnets move in opposition to cancel center-of-mass movement and resulting vibration, are coupled via a spring linkage to the middle of a circular spring-metal resonator plate, which is die-formed from a flat sheet to achieve desired properties of static and vibrational compliance. The opposite side of this sheet contacts fluid, which forms a thin layer captured between the sheet and an opposing rigid surface. When the plate surface vibrates, mostly in an axial direction perpendicular to the plate surface, the captured fluid is forced to vibrate mostly in a radial direction and through a much larger displacement distance than for the plate. The resulting system has a number of radially-symmetric vibration modes with strong coupling to the transducer. The lowest-frequency or fundamental mode has an effective inertia arising primarily from entrained fluid, with a lesser inertia contribution from the plate and magnetic driver assemblies. The spring restoration of the plate, in conjunction with the mostly-fluid inertia, give rise to a strong resonant vibration mode that is driven by the transducer. In its fundamental resonance, the plate and fluid layer develop a large vibrational pressure amplitude at the center and a smaller pressure amplitude of opposite polarity near the perimeter, with fluid vibrating radially between the center and edge regions in response to the radial oscillatory pressure gradient. The pressure under the center of the plate is tapped for conversion from AC to DC fluid power and controlled net displacement, using a fast check valve. In a preferred embodiment, the AC driving pressure from the plate is applied to the outlet side of the check valve. A volumetric compliance, e.g., an air pocket separated from the fluid by an elastomer sheet, acts as a bypass capacitor on the inlet side of the check valve, permitting very high fluid accelerations across the valve by decoupling the inertia of the fluid column leading to the valve inlet. On the outlet side of the valve, the compliance of the spring plate itself serves as the bypass capacitor for the fractional-cycle flow pulses. A narrow passageway conducts fluid away from the AC pressure region to the pump outlet while the fluid inertia of the passageway isolates the AC driving pressure from the outlet. A similar narrow passageway admits fluid from the source to the inlet side of the check valve while minimizing the escape of vibrational energy toward the fluid source. Thus, electrical energy is transformed efficiently into resonant fluid vibrational energy and thence into pumping energy with a minimum of vibrational energy transfer to the environment and, consequently, a minimum of noise generation.

To synchronize the flow of electric power to the transducer for driving the pump, circuitry is used to derive two signals: a drive force signal with phase angle made to approximate that of the force arising from the voltage and current applied to the transducer; and a response velocity signal. The drive frequency is caused to approximate the lowest frequency for which the drive force and response velocity signals are in phase for strongly-coupled power transfer into the transducer. In the moving magnet driver of the preferred embodiment, the force signal is derived from the measured current flowing through the driver winding, while the velocity signal is derived from the voltage output of the sense winding, with a correction applied to cancel voltage in the sense winding attributable to inductive coupling directly from the drive winding. Once the "force" and "velocity" analog signals are developed, the drive frequency determination may be accomplished by regenerative feedback oscillation or by a frequency-controlled phase-lock-loop, which seeks out that drive frequency for which force and velocity are in-phase. Various combinations of analog and digital circuitry are applicable.

The circuitry that drives the plate at resonance functions as a resonance frequency detector. Operated with a low-level drive amplitude, insufficient to crack the check valve and cause pumping, the drive circuitry produces a frequency output that is an excellent measure of fluid volume in the pump. The frequency signal is readily calibrated to pressure as well, given a consistent curve relating volume to pressure. The referenced application of Seale entitled "CONVERSION OF FLUID VOLUME, DENSITY, AND VISCOSITY TO FREQUENCY SIGNALS," Ser. No. 8/258,198, filed Jun. 10, 1994, now U.S. Pat. No. 5,533,381 and hereinafter referred to as "Measurement System Application," provides a detailed description of how frequency signals derived from the motion of a fluid- coupled resonator plate, at a fundamental frequency and at higher harmonic resonance frequencies, can be used to obtain a highly reproducible volume measurement, independent of fluid properties (as long as such fluid is essentially incompressible) and the effects of changing temperature. By the methods described there, the pump of the present invention can be used to determine its internal fluid volume and output pressure. Given a knowledge of the density of the working fluid that develops AC pressure under the resonator plate, plus an indication from that resonance frequency of the inertial impedance to radial flow under the plate, the system controller can estimate AC output pressure amplitude to the check valve. By monitoring the threshold of AC output pressure amplitude at which a rapid increase in damping indicates opening of the check valve and conversion of fluid power, the system controller can estimate the pressure differential from inlet to outlet and the absolute pressure at the inlet. Further monitoring of the damping effect of transformed DC flow through the pump makes possible an approximate computation of pumped fluid flow. Further signal interpretation reveals the approximate fluid impedances of the source and load and the approximate viscosity of the fluid passing through the valve. This information can all be inferred from an examination of resonance frequencies and the variation of the fundamental resonance frequency with a controlled, variable electrical drive amplitude.

The high-speed check valve is a critical component of the new pump system. It consists of a toroidal elastomer o-ring that covers and closes a circular orifice. A sufficient pressure differential from the inside to the outside of this o-ring unseats the ring and displaces it radially, opening circular slots for fluid flow through the orifice and around the ring. The axial height of the orifice can be adjusted so as to fine-tune the circumferential tension in the o-ring, and thus the bias pressure for cracking the check valve.

When two pumps are coupled in series, the pair serves as a servo-pump capable of precision control of output volume. The check valves of each pump are biased to be normally-closed, with sufficient forward cracking pressures to give a "dead-zone" in the pressure at the inter-stage coupling of the two pumps, a range of pressures over which both pump valves are closed. To track volumes from source to sink, first a low-level resonance measurement determines initial inter-stage volume. The inlet driver is driven at relatively high amplitude to draw in fluid, stopping before the inter-stage pressure rises enough to open the outlet-side valve. A second low-level resonance measurement redetermines inter-stage volume, revealing by subtraction the amount that was pumped into the inter-stage. The outlet driver is next driven at high level to expel fluid, stopping before the inter-stage pressure falls enough to open the inlet-side valve. A third low-level resonance measurement determines final inter-stage volume, revealing by subtraction the amount that was pumped out. The non-inter-stage driver is exposed to a fluid-line pressure, which is determined from low-level frequency measurement. The pump pair can be configured to measure either inlet pressure or outlet pressure in addition to inter-stage volume.

Bubbles in a pump stage alter the resonant frequency response dramatically, revealing the approximate quantity of gas. Bubbles of any significant size move the resonance of the chamber outside a plausible range that could have been caused by variation in volume. A very small volume of gas bubble has a more subtle effect that can be quantified by phase/frequency testing. An observed effect of bubbles is to split the "fundamental" resonance mode into a pair of resonances. When the bubble is too small to generate a readily detectable splitting of the fundamental, the ratios of the fundamental resonance frequency to higher harmonic frequencies are nonetheless altered in a pattern that is not characteristic of any variation in density and viscosity of the working fluid under the resonator plate.

Large bubbles interfere with pressure generation and physically prevent pumping. The effect of a large bubble is to lower the fluid impedance to the plate and drive up the plate vibration amplitude for a given excitation amplitude. As the vibration amplitude rises, various damping effects limit the vibration increase, with the result that output pressure falls. A strong drive pulse can force an interfering bubble through and out of the pump, but if there is too much gas in the pump, the maximum transducer drive signal proves insufficient to develop AC pressures that overcome valve bias thresholds and flush air through the pump. This inherent inability to pump large quantities of air is good news in medical infusion applications where pumping excess air into a patient is a safety hazard.

DESCRIPTION OF A PREFERRED EMBODIMENT

The SUMMARY section immediately above is illustrated in concrete detail by the figures and the major components labeled therein and described in this section. While reading the enumeration of parts to follow, the reader is encouraged to refer back to the SUMMARY OF THE INVENTION just given, to understand how the individual parts function in concert.

Housing And Subassembly Layout

Figure 1A:
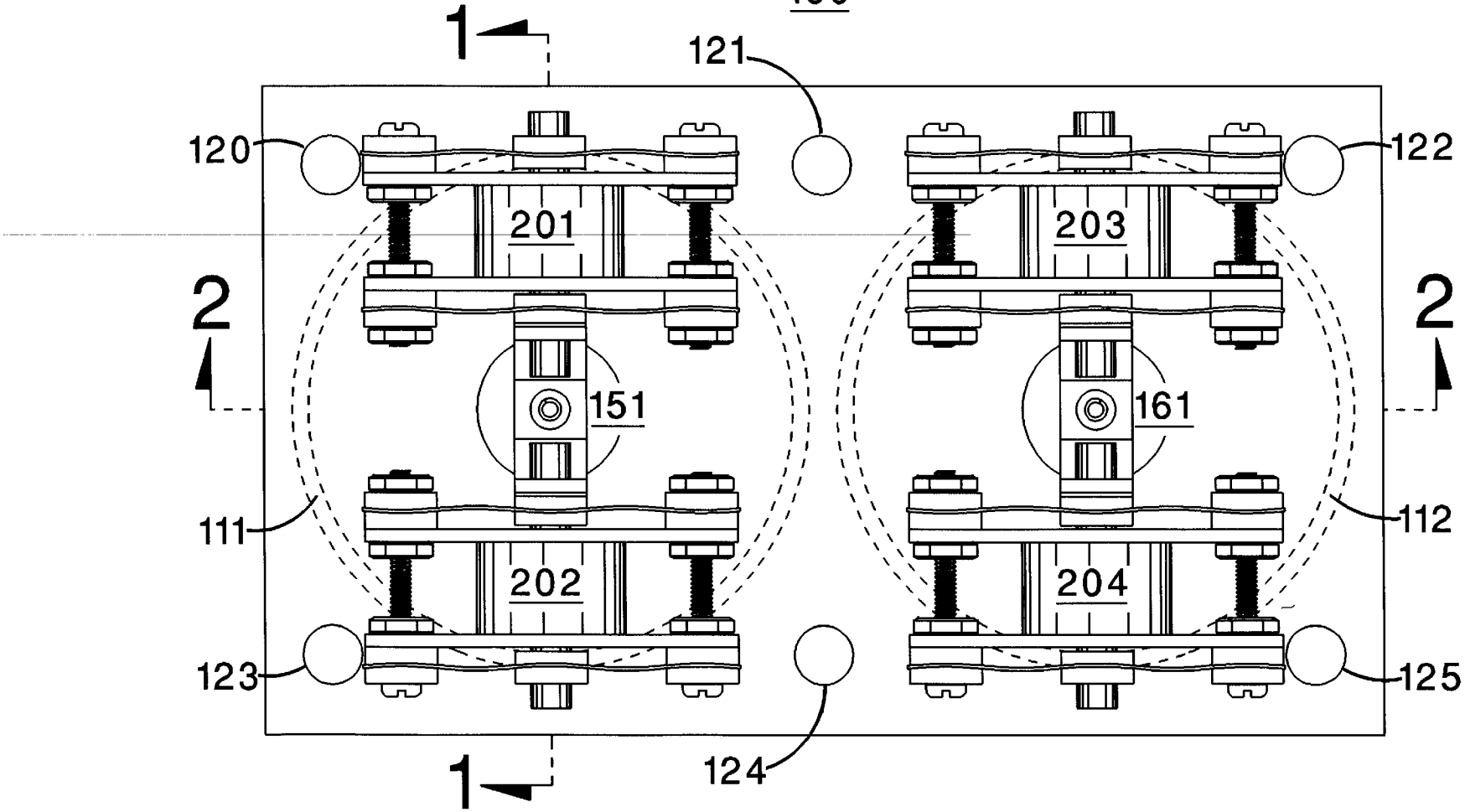
FIG. 1A illustrates in plan section a two-stage fluid pump and volume measurement system, emphasizing the electromagnetic driver/sensor subassemblies.
Figure 1B:
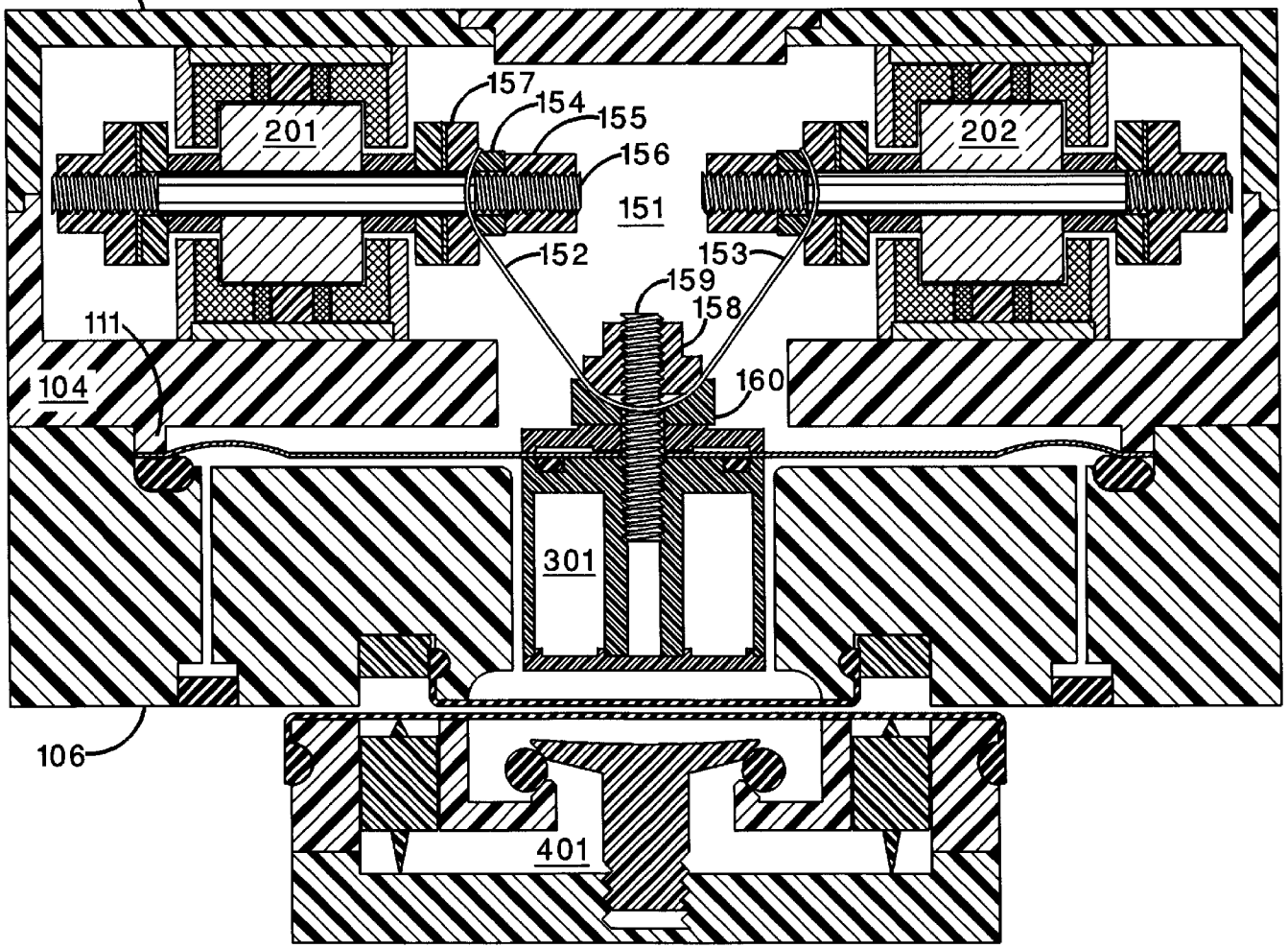
FIG. 1B illustrates elevation section 1—1 of FIG. 1A, providing the best functional overview of the complete pumping and measurement system.
Figure 1C:
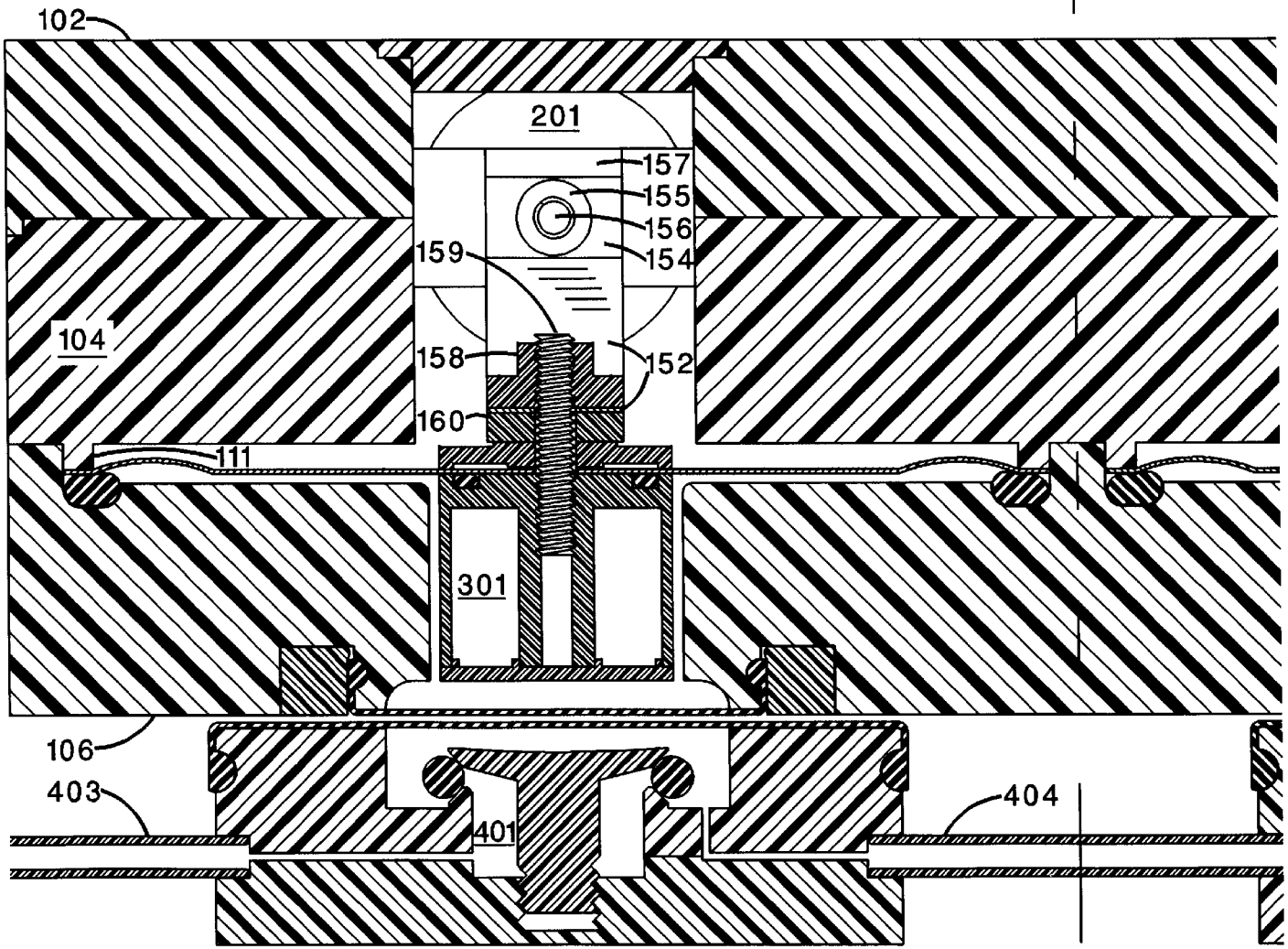
FIG. 1C illustrates elevation section 2—2 of FIG. 1A, a plane perpendicular to that of 1 B and illustrating the direction of fluid flow through the cassettes.
Figure 2:
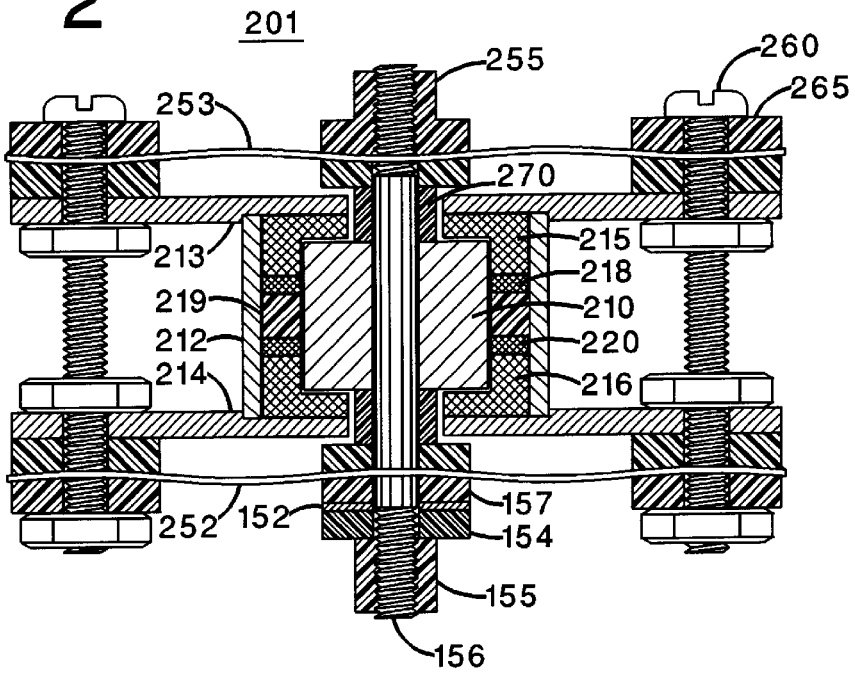
FIG. 2 illustrates details of an electromagnetic driver/sensor subassembly.
Figure 3:
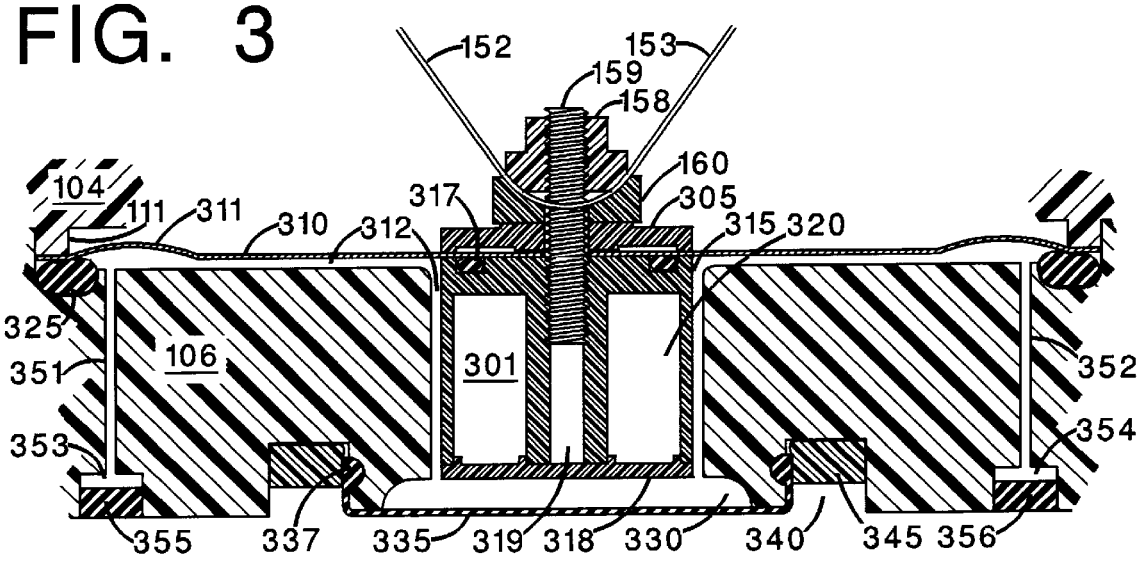
FIG. 3 illustrates details of a resonant cavity to transform vibratory force into vibratory pressure and indicate volume displacement via resonance change.
Figure 4A:
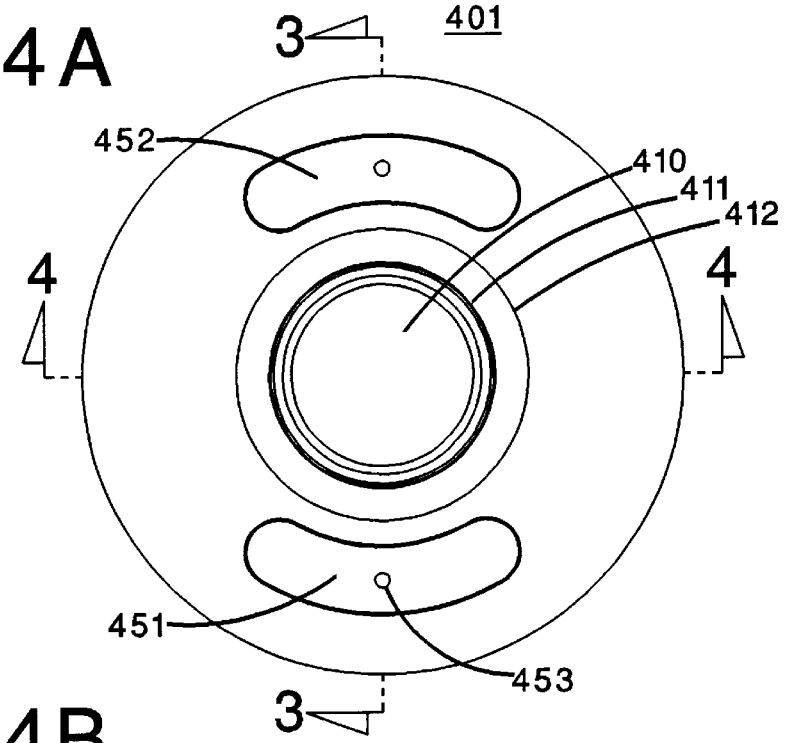
FIGS. 4A, 4B, and 4C parallel the sections of FIGS. 1A, 1B, and 1C for detailing the structure and function of a fluid cassette.
Figure 4B:
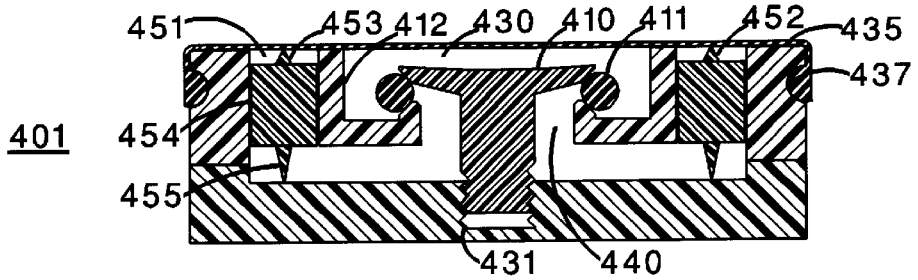
Figure 4C:
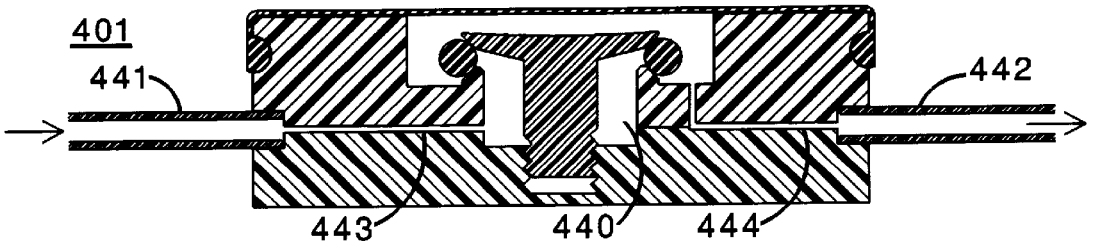
Figure 5:
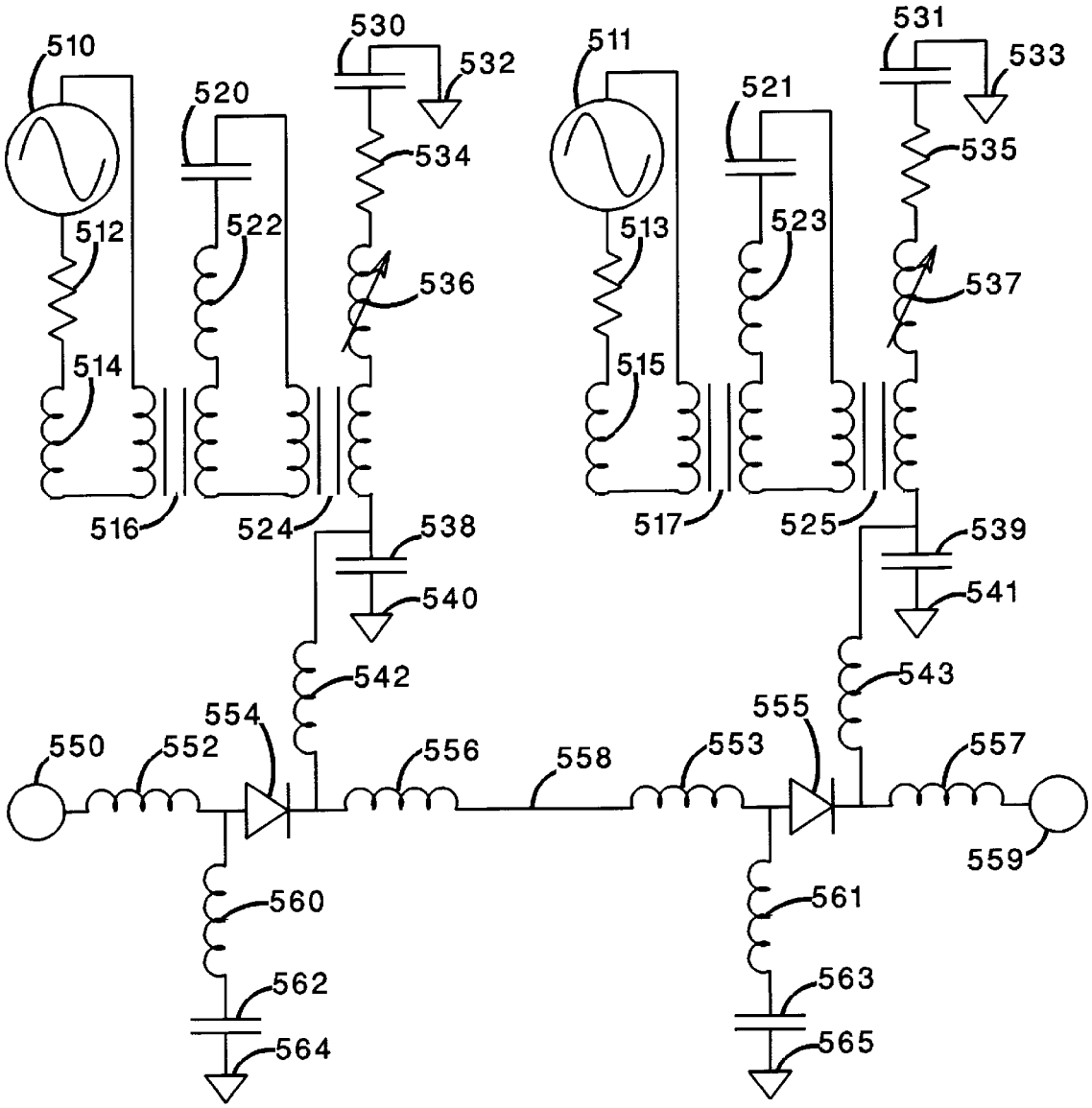
FIG. 5 shows a dynamic fluid circuit schematic, using common electronic circuit symbols for their fluid analogs, to illustrate pumping in the cassette.

The major electromechanical and fluidic subsystems of the preferred embodiment, a two-stage pump, are illustrated assembled in FIGS. 1A, 1B, and 1C, and in subassembly detail diagrams in FIGS. 2, 3, 4A, 4B, and 4C. FIG. 5 illustrates the fluid energy conversions of the system by an analogous electronic circuit schematic. In the subassembly diagrams, FIG. 2 shows details of electromagnetic driver/sensor subassembly 201, one of four like subassemblies hereafter referred to simply as drivers. FIG. 3 shows details of resonant transformer assembly 301, a resonant cavity that transforms vibratory mechanical force into vibratory "AC" fluid pressure while simultaneously indicating volume displacement by variations in its resonant frequency. FIGS. 4A, 4B, and 4C show fluid cassette subassembly 401 which, in tandem with a like subassembly, transforms AC fluid pressure into net fluid displacement. The plan view section planes of FIGS. 1A and 4A are parallel XY planes at the respective levels of the drivers and of the tops of the cassettes, while the elevation section planes of FIGS. 1 B and 4B are identical, as are the planes of FIGS. 1C and 4C, with the FIG. 4 sections separating out cassette details shown in the FIG. 1 sections.

FIG. 1A shows a plan view in the XY plane, with the top housing piece removed, looking down on the electromagnetic driver/sensor subassemblies 201 and 202 of the left pump section, and subassemblies 203 and 204 of the right pump section. Between 201 and 202 lies linkage assembly 151, which is like assembly 161 lying between 203 and 204. Clamp ridges 111 on the left pump and 112 on the right pump are seen in "x-ray" view since they lie below the level of the drivers, being downward-facing ridges in the housing assembly component that holds the drivers from below. These ridges define the outer perimeters of the resonant plates that transform mechanical into fluid power, as described later. Through holes 120, 121, 122 on the top from left to right, and 123, 124, and 125 on the bottom from left to right in FIG. 1A, extend from countersinks on the upper housing surface to threaded holes on the lower housing surface, allowing the pump housing layers to be fastened together tightly.

FIG. 1B, taken at the section 1—1 of FIG. 1A, is an elevation section in the YZ plane, showing most of the details necessary to understand the workings of a single pump section. The important features missing from FIG. 1 B but shown in FIG. 1C, an elevation section in the XZ plane at 2—2 of FIG. 1A, are the inlet and outlet fluid pathways for a cassette section. FIG. 1C shows the left half of the assembly of FIG. 1A plus a little of the right half, enough to indicate the repeated structure to the right of dashed center line 134 matching the structure shown completely to the left of 134. Referring primarily to the illustration in FIG. 1 B, the major parts of the preferred two-stage pump embodiment divide broadly into the pump housing assembly 100 and the contained subassemblies, plus the separable dual cassette subassembly. The subassemblies contained in the left pump section of 100 are electromagnetic driver/sensor subassemblies 201 and 202, mechanical linkage subassembly 151, and resonant transformer assembly 301. The left half of the separable dual-cassette assembly is designated as subassembly 401. The repeated right side counterparts of 301 and 401, are essentially identical to the identified left side subassemblies. Briefly, driver/sensors 201 and 202 develop opposing horizontal thrusts, with the center of mass common to the driver pair remaining virtually motionless as the individual drivers vibrate. The horizontal thrusts and pulls are transformed by linkage 151 into a single vertical vibratory force, which is coupled down into resonant transformer assembly 301. The output AC pressure from assembly 301 is coupled through a mating pair of membranes, drawn slightly separated, into cassette section 401. The section view of FIG. 1 B, repeated in FIG. 4B for clarity of labeling, illustrates the high-frequency fluid pathway for efficient valve rectification of fluid flow at high frequencies, including into the mid-audio range. The section view of FIG. 1C, repeated in FIG. 4C for labeling, shows the low-frequency fluid pathway from fluid inlet to outlet. As shown in FIG. 1 C, the outlet fluid path 404 from cassette 401 connects the output side of 401 to the input side counterpart right side equivalent subassembly. As discussed in the SUMMARY OF THE INVENTION section above, this coupling leads to an operating mode in which the two pump halves operate alternately as pumps while the left pump, shown in FIGS. 1B and 1C, operates for bursts at low-vibration amplitude to take volume measurements and thereby determine the total fluid volume that has passed through to the outlet side of the pump.

FIGS. 1A, 1B, and 1C are used to illustrate the pump housing and linkage subassembly 151. The other subassemblies within the pump housing, and the cassette subassemblies, are detailed with reference to later figures. Referring primarily to FIG. 1 B, the pump housing consists of cap piece 102, middle piece 104, and base housing piece 106, which are assembled using screws through holes 120 through 125, shown in FIG. 1A, as already described. Cavities in 102 and 104 capture paired drivers 201 and 202, plus like drivers 203 and 204 on the right side. The opposing vibrations of 201 and 202 are converted into a vertical or Z-axis vibratory force by linkage assembly 151. Ridge 111 of housing part 104 serves as a clamp for the resonator plate 310 in resonant catty subassembly 301, whose input is Z-axis vibratory force from 151 and whose output is AC fluid pressure coupling down through mating elastomer membranes into the fluid in the outlet chamber of cassette section 401, which is the inlet half of the dual cassette assembly also including the equivalent right side subassembly and a housing to hold the two cassette subassemblies together, as would be understood by those skilled in the field of the invention.

Although not specifically shown in the drawings, a dual-pump housing may be provided for serving the following utility functions. The dual cassette assembly in a typical application is part of an intravenous infusion set, including coupling means to a bag or other fluid source leading to 403 (FIG. 1C) at the dual cassette inlet. Also included in an infusion set would be coupling means from the outlet side of 402 to a patient intravenous infusion site. As added structure surrounding pump assembly 100 and the dual cassette assembly, there will typically be a housing including power supply interface, from a utility line or battery pack or both; a user interface including display and some combination of touch pad or keys or knobs; a data interface; an electronics assembly including pump driver and sensor electronics, computation, and communication with the interfaces; and an outer housing to hold the vibratory pump module and clamp it in secure contact with the dual cassette assembly, e.g., via a door or slide-in cassette slot with lever for clamping.

Acoustic Isolation

To minimize noise leakage into the environment, the outer housing will typically include vibrational isolation between the joined dual-cassette/dual-pump modules and the outer housing, so that the outer housing does not act as a sounding board for broadcasting vibrations coming from the inner assembly. The outer housing may also include means for forming a sealed acoustic chamber surrounding the internal vibrating parts, thus further reducing the broadcast of acoustic noise. These noise reduction measures, as needed, are added to a primary noise isolation strategy, detailed in this specification, that is based on two levels of inertial balancing of the pump and coupled pump-cassette subassemblies. The first level of balancing is to null the vibratory motion of the pump center of mass when the drivers vibrate. The second level of balancing is to null the pulsing motion of the center of mass arising when a pulse of fluid travels through a check valve. In both cases, the general approach is to provide a fluid path that completes a loop or "U" shape around the bottom of a torus, so that downward mass motion in one area is offset by upward mass motion in another area so that the overall center of mass is static. Details of these approaches follow below.

Pump and Cassette Functions

Pump housing assembly 100 and its contained subassemblies are referred to collectively as "the pump," whose functions are broadly to:

1) transform AC electrical power into AC fluid pressure at resonance;
2) couple the AC pressure to a fluid-pumping cassette;
3) send an AC sense signal indicative of resonances, both for determining an optimum pumping frequency and for evaluating volume, pressure, and other aspects of pump/cassette function; and
4) maintain a nearly fixed dynamic center of mass as internal components and fluid vibrate, thereby minimizing exterior vibration and consequent noise generation.

Cassette assembly components, referred to collectively as "the cassette," function broadly to:

1) receive AC pressure from the pump;
2) provide one-way check valving to convert AC pressure into net pumped fluid displacement;
3) provide inertial bypassing on the side of the check valve opposite the pump, to facilitate the rapid acceleration and deceleration of fluid flow needed to accomplish efficient fluid power rectification at high frequencies;
4) provide fluid inlet and outlet ports that are inertially isolated from the AC drive pressure; and,
5) maintain a nearly fixed dynamic center of mass as pulses of fluid move through the valve, thereby minimizing exterior vibration and consequent noise generation.

Force Linkage Subassembly

The force linkage subassembly 151, is illustrated in FIGS. 1A, 1B, and 1C. Other subassemblies will be described with reference to separate subassembly figures. As shown primarily in FIG. 1 B, with perspective information provided by FIGS. 1A and 1C, subassembly 151 consists of a "V" shaped spring metal band having straight linkage sections, 152 on the left and 153 on the right, that provide angled thrust/compression members to transform horizontal motion above on the left and right into vertical motion below. The metal band is provided with holes in the center and near either end, which slip over threaded rod 156 on the left, an analogous rod on the right, and threaded rod 159 in the middle. On the left, side 152 of the band is clamped between planar concave piece 157 and planar convex piece 154, which is pressed onto 157 by nut 155 threaded onto rod 156. An analogous structure on the right clamps side 153 of the band, in the middle, piece 160 functions much like 157, providing a planar concave bending surface, while threaded piece 158 functions like combined pieces 154 and 155 to give a planar convex surface clamping the middle of the band into 160 utilizing threaded rod 159. The curving clamp members hold the bend portions of the strip so that the free ends emerge lined up such that free sections 152 and 153 are nearly straight. The vibratory motions involved are of sufficiently small amplitude relative to the lengths of sections 152 and 153 that the transient curvature of sections 152 and 153 within a vibration cycle is negligible. A leverage ratio between horizontal and vertical motion is determined by the tangent of the slope of segments 152 and 153. A steeper slope to sections 152 and 153, corresponding to a more acute angle formed at the middle bend of the strip, results in a greater mechanical advantage of the drive subassembly of 201 and 202 relative to force coupled into the resonant transformer assembly 301. An increasing mechanical advantage means more force transfer for a given driver electrical current, but it also means that the driver must allow for an increased peak-to-peak motion and, perhaps more important, the increasing mechanical advantage implies a greater effective mass or inertia of the driver as seen by the resonator section. Specifically, apparent driver inertia equals actual driver inertia (summed over left and right sections) multiplied by the square of the tangent slope of segments 152 and 153. At a chosen frequency, driver inertia is effectively nullified by providing spring restoration in each individual driver, thus tuning the drivers within or not too far from the operating frequency range of the pump. In this manner, the magnitude of forces that must be transmitted through linkage 151 is substantially reduced, and stresses tending to concentrate near the center of the vibrating plate in 301 are similarly reduced. The disadvantage of a very high mechanical advantage provided by the drivers 201 and 202 over the resonator coupling is that, even with resonant tuning of the drivers 201 and 202 near a typical operating frequency, the bandwidth for energy transfer into the fluid resonator is curtailed. This bandwidth curtailment results in reactive power transfer at volume extremes (making it harder to couple real pumping power) and results in reduced variation in resonant frequency as a function of volume displaced into or out of the resonator section. This latter reduction works against sensitive volume detection. It is generally advantageous to reduce the size and mass of the drivers, and then to compensate by increasing the mechanical advantage of the drivers via linkage 151, up to a point of diminishing returns either to where the axial travel of the moving member in the driver becomes too large for efficient design, or to where there is no advantage to further miniaturization of the driver assembly.

Driver/Sensor Options

Electromagnetic driver/sensor subassembly 201 of the preferred embodiment is described with reference to FIG. 2. Before beginning this specific discussion, however, we review the scope of alternative driving/sensing methods. The referenced Measurement System Application describes two electromagnetic and two piezoelectric transducer approaches for volume sensing: voice coil driver in impedance bridge circuit; voice coil driver with separate velocity-sense winding; piezoelectric disk driver in impedance bridge circuit; and piezoelectric disk driver with electrically isolated bending motion sense area. Beyond volume sensing, sufficient power transfer for fluid pumping has been demonstrated with both voice coil drivers and piezoelectric disks. The driver/sensor described with reference to FIG. 2 has the advantage of extremely small size in relation to its power-handling capability and efficiency, especially when constructed around a high energy-product rare earth magnet. The stiff tuned suspension of driver subassembly 201 is achieved fairly simply within the constraints of the electromagnetic topology. It should be noted that piezoelectric disks laminated directly to both the central upper and lower surfaces of the resonator plate have been used to achieve fluid pumping, but only by approaching the cyclic stress limits of the piezoelectric material. Those experimental units failed after a few minutes of operation due to a large increase in plate damping, which has been ascribed to partial delamination of the disks from the plate at high vibration amplitudes. Piezoelectric disk drivers have an advantage of economy and simplicity and low dynamic mass, so that further design optimization using that piezoelectric approach is likely to yield practical pump designs for some applications. Piezoelectric benders differ from disks primarily in using one-dimensional rather than two-dimensional curvature to generate motion. Benders could potentially serve as driver/sensors for pumping. A potential disadvantage of piezoelectric actuation and sensing is the relatively high mechanical damping factor inherent in piezoelectric ceramic materials, which can limit resonant Q-factors and reduce the capacity of a system to resolve small changes in volume while simultaneously providing for piezoelectric energy transformation sufficient to pump fluids. (For volume sensing alone, the mechanical influence of piezoelectric ceramic, or polymer, material on Q-factor can be minimized by using metal as the dominant spring material.)

A Moving Magnet Driver/Sensor

Driver/sensor assembly 201 consists of a movable permanent magnet 210 placed in the center of a magnetically soft (i.e. low coercive force, low hysteresis, high permeability) ferromagnetic yoke consisting of cylinder 212 captured in circular indentations in end plates 213 and 214. These end plates include center holes through which extend the ends of rod 156 (as previously noted in FIGS. 1B and 1C) as well as spacer collar 270 above 210 in FIG. 2 and a like collar below 210. Magnet 210 is a hollow cylinder with a relatively small center bore that allows coaxial mounting on rod 156. Making rod 156 non-ferromagnetic avoids partial short-circuiting of the permanent magnetic field. A low-density rod material choice such as aluminum helps minimize the dynamic moving mass of the driver. Inside the yoke, in the axially-opposed and outer ends, are drive coils 215 and 216, which are shown wound for an "L" shaped cross-section wrapping around the edges of magnet 210 for maximal proximity of windings to the center of magnet 210. Coils 215 and 216 are wired for opposite- rotation electric currents, so that an axial magnetic field gradient is produced when current flows through the windings. This gradient produces an axial force on magnet 210, exerted in the direction for which the winding-produced magnetic field increases the strength of the permanent field inside the magnet. Sense coils 218 and 220 are located axially inside drive coils 215 and 216, surrounding magnet 210, at a lesser axial spacing than the drive coils 215 and 216. This lesser axial spacing is less advantageous for coil/magnet coupling but quite sufficient for velocity sensing. The "prime real-estate" for windings is devoted to driving. As with the drive windings 215 and 216, sense windings 218 and 220 are wired so that opposite-rotation-sense-induced winding voltages produced by magnet motion will be added rather than subtracted in the output signal.

Note that a portion of the sense winding output voltage will be caused not by magnet motion, but by rate-of-change of field strength from the drive windings 215 and 216. This rate-of-change crosstalk signal is further complicated by any eddy currents that arise in the permanent magnet 210 or the yoke pieces 212–214, which can alter the phase and amplitude of the cross-talk signal. Cross-talk into the velocity-sense output must be characterized and compensated for in order to obtain an accurate velocity-sense signal. To minimize the complicating and energy-wasting effects of eddy currents, an axial-running slit may be cut in cylinder 212 and extended into a radial slit in end plates 213 and 214, to interrupt eddy currents circling around the axis of rod 156. To retain structural integrity, the slit need not be extended across the middle of cylinder 212, but can be broken into slits extending from an unbroken center region of the cylinder 212. In this center region, the time-varying magnetic field components caused both by coil currents and by magnet motion will nearly cancel, so that eddy currents around the center-region will have negligible effect.

Between sense coils 218 and 220 is passive spacer piece 219, a structural convenience for stacking the coils stably in the yoke. The spacer piece 219 is passive in that it is non-conducting. Note that the axial clearance for magnet 210 is quite small, since only a small vibration amplitude is required and since mechanical excursion limits protect the suspension springs from being over-stressed whenever rod 156 should receive a hard external push. Shown on the lower end of rod 156 are end parts 154, 155, 157, and the edge of spring segment 152, all discussed in relation to FIG. 1B. Piece 157 is shown, in the plane illustrated by FIG. 2, to be split and to include a curving slot to capture and bend flat rectangular spring strip 252. On the opposite axial end, cap assembly 255 similarly clamps spring strip 253. Low density material, e.g., plastic, is preferable for the cap assemblies on the center shaft to minimize moving mass. On the upper right, clamp assembly 265 is seen capturing and bending the right end of strip 253, with screw 260 and various nuts completing the clamp assembly. The other end of strip 253 and both ends of strip 252 are similarly clamped in a structure that, overall, includes three threaded shafts or screws (one on either side, one in the middle) and six spring clamp assemblies.

The bending preloads in spring strips 252 and 253 bow them so that they can flatten to lesser curvature at large vibrational excursions, rather than stretching in-plane. If the strips 252 and 253 are initially flat, then large vibrational or position-bias excursions stretch them as they are forced to span the hypotenuse lengths of triangles of constant base length (equal to the unstretched strip length) and variable height (equal to the axial excursion). The tensions in the strips 252 and 253 stretched to hypotenuse lengths vary roughly as the square of the axial driver shaft excursion from neutral position, and these tensions multiplied by the sines of the angles resolving tension into axial force result in a roughly cube-law axial force restoration term, which is added to the desired linear restoration term. If the strips are sufficiently pre-curved, then the hypotenuse change-of-length will mostly unbend the curvature rather than stretch initially flat strips, resulting in much smaller changes in in-plane tension and much smaller nonlinearity of axial restoration. The thickness, free length, and width of each strip is chosen for competing criteria of compactness, acceptable stress limits on the spring material, and a net axial restoration force coefficient that tunes the moving driver mass appropriately to minimize stresses in the fluid resonator plate, with additional consideration of pre-stress curvature and acceptable limits for non-linearity of the restoring force.

Resonant Mechanical/Fluid Power Transformer

FIG. 3 illustrates the resonant transformer of mechanical to fluid power, 301, the core of the pump invention. As discussed above, axial vibrational force enters this transformer on linkages 152 and 153 in this preferred embodiment, or more generally through any shaft or linkage appropriate to impart vibrational force to the center region of resonator plate 310. As drawn, linkage strip segments 152 and 153 of a single strip, clamped between blocks 158 and 160 by threaded rod 159, impart vertical axial force via block 160 on plate cap 305 and, via rod 159, on plug 315, which captures plate 310 from below and draws it securely against cap 305, clamping a central area of the plate and distributing the forces transferred through the linkage. 0-ring 317, captured in a gland in the top surface of plug 315, prevents any fluid leakage from cavity 312 in to the threads of rod 159, which threads could otherwise form a leakage path. Cap 305 is cut out in the center underside so that an axial preload from cap 305 will deform the center of the piece downward and generate a strong clamping pressure around the perimeter, as the center region descends to contact the plate 310. This positive center and perimeter clamping ensures reproducible bending and vibrational behavior in plate 310. Plug 315 is hollowed out in annular cavity 320, which is closed by bottom cap 318. Tapped hole 319 in the body of plug 315, for receiving the thread of 159, is also capped on the bottom by bottom cap 318. The open volumes of hole 319 and cavity 320 serve to reduce the mass of plug 315, with a goal of reducing the average density of plug 315, including hollow spaces, to a value substantially less than that of the cavity 312. The resulting positive buoyancy of 315 in the transmission fluid serves a function in dynamic balancing, as will be described soon.

Plate 310 includes a low-profile annular ridge 311 which serves to linearize compliance to volume change, much as the precurvature in driver suspension strips 252 and 253 linearizes the compliance of those strips to axial center displacement. The outer edge of plate 310 is clamped down by ridge 111 of housing piece 104, with the lower edge surface being pressed into o-ring 325, which seats on its lower surface in a gland in housing piece 106. The outer perimeter of this gland rises to capture and center plate 310 and simultaneously center-align ridge 111 as it descends to capture plate 310. When these parts come together, they seal off the outer perimeter of fluid cavity 312, which extends inward as a thin washer shape bounded above by plate 310 and below by the upper surface of housing piece 106. Cavity 312 meets an inner boundary at the outer surface of plug 320, where the cavity bends downward into a thin cylinder bounded inside by plug 320 and outside by a circular bore in housing piece 106. This cylinder opens at the lower end into cavity 330, which is bounded from above by cap 318 of plug 315, on its upper and outer perimeter by housing piece 106, and from below by elastomer cap 335, which presents a thin membrane across the bottom of cavity 330. Cap 335 is a shallow cup with edges that slip over the inner perimeter of annular depression 340 in the bottom of piece 106. Gland 337 on the inner surface of depression 340 captures a mating ring bulge in the upper edge of cavity 330, while circular clamp ring 345 is pressed up into depression 340 to capture the bulge on cap 335 in gland 337.

To prime the pump of the present invention with transmission fluid and purge air from cavity 312 and its extension into cavity 330, fluid passageways 351 and 352 are provided in either side of housing piece 106, connecting between opposites sides of the washer-shaped portion of cavity 312 and priming ports 353 and 354. The fluid connections into cavity 312 are made close to the outer perimeter seal of o-ring 325, so that appropriate tilting of the pump places the junction of cavity 312 with either passageway 351 or 352 at the highest point of the fluid cavity, where air can be purged. The priming ports 354 and 355 are normally closed and include temporary connector provision, e.g., elastomer plugs 355 and 356, which can be penetrated by a hypodermic needle for priming and which will reclose tightly when the needle is removed. To prime the pump, typically cap 335 is off while fluid is injected into one of the priming ports 354 or 355 to fill cavity 312 and cavity 330. The cap 335 is then applied, clamped into place, and the assembly inverted into the orientation of FIG. 3. Transmission fluid is then injected into one port, withdrawn from the opposite port, and cap 335 massaged over cavity 330 to coax bubbles up into the washer-shaped portion region of cavity 312. A tilting of the pump to raise the fluid withdrawal port to the top of the cavity 312 permits air to rise and be withdrawn from that port, completing the priming.

The dynamics of vibration modes for resonant transformer 301 are like the dynamics of vibration modes used for volume and fluid property measurement, as described in the referenced Measurement System Application. FIG. 4 in that application illustrates a resonant plate much like plate 310 of this application, consisting of a flat middle region, an annular ridge, and a thin fluid layer between the plate and a flat confining surface below. As shown in FIG. 4 of that referenced application, an acceleration of the plate surface from a center-up and edges-down contour 430 toward a center-down and edges-up contour 431 causes an outward axial acceleration of captured fluid, as shown by arrows, and an accompanying pressure gradient from positive near the center to negative near the edge, as in pressure contour 460. The resonance frequency depends on the effective spring constant of the resonator plate, ratioed to the effective mass, which is attributed largely to fluid inertia and which is sensitive to variations in the volume captured in the fluid layer under the plate. Many fluid measurement and flow control applications place a priority on minimizing plate size while maintaining a reasonably high volume compliance over a reasonably wide pressure range. The combination of volume compliance and pressure range implies a capacity to store pressure-times-volume energy in a spring plate with a diameter that is squeezed to save space and with a thickness that is squeezed to maintain volumetric compliance.

The optimization criteria for a pump-and-measurement system, as in FIG. 3 of the present application, satisfy the conflicting demands for small size and high volume compliance described above, in addition to criteria specific to pumping. Large vibrational excursion and pressure amplitudes are added to the "static" (i.e. non-vibrational, non-dynamic) pressure swings that the plate must withstand, although it turns out that cyclic stresses due to static pressure swings tend to dominate slightly over high-frequency cyclic stresses. Of greater significance is that the vibration driver, to achieve power efficiency, tends to be designed with a much larger moving mass than a driver/sensor designed for volume sensing alone. Though this mass can be "tuned" with springs to reduce reactive-phase force transfer through the linkage to the plate, operation over a bandwidth of pumping frequencies still implies that relatively large non-power-transferring inertial or spring forces must pass between the center of the plate and the driver. It is these forces that demand an expanded clamping region in the center of the plate, as in components 305 and 315 of the present application. Another priority specific to pumping is to design for a not-too-high resonant operating frequency, e.g., not far above 1 KHz, so that practical cassette and o-ring geometries can accomplish efficient fluid power rectification without excessive fluid inertial impedance. Making fluid layer 312 thinner accomplishes a reduction in resonant frequency, but at the cost of increased fluid friction and a reduced resonant Q-factor, issues that compromise both volume measurement resolution and efficiency of fluid power conversion. Reducing the resonator plate thickness lowers resonant frequency and raises volumetric compliance, both desirable goals, while tending to push upper limits for stress and fatigue in the plate.

A way to increase vibrational pressure output amplitude at a given plate vibration amplitude, and simultaneously to increase vibrating fluid inertia (which has the desirable effect of lowering the resonant frequency) while maintaining a thick fluid layer and a high fluid Q-factor, is to extend the horizontal washer-shaped region of fluid layer 312 substantially down axially in the cylindrical zone around the outside of plug 315. Thus, the plug and clamp geometry of FIG. 3 introduces an element that complicates the vibration mode diagram of FIG. 4 of the referenced Measurement System Application. The fluid acceleration region and pressure gradient region now have radial and axial components. In the mechanical representation, the single spring-in-the-plate model is complicated by the addition of a second significant spring, in the driver. The formerly negligible driver/sensor mass becomes a significant mass, comparable in magnitude to the dynamic volume-sensitive fluid mass. Nonetheless, the vibration modes used for pumping and sensing remain qualitatively the same as described in the referenced Measurement System Application. A lowest-frequency or fundamental mode is employed for pumping and primary volume sensing. A higher frequency mode, preferably the next-higher-frequency mode, is used for fine-tuning the volume measurement, correcting for temperature-dependent fluid property effects and aiding in positive identification and approximate quantification of air bubbles in the system. As described in the referenced Measurement System Application, quantification of phase/frequency slope in the vicinity of the lowest resonance provides the added information needed for a fairly thorough characterization of properties of the "transmission" fluid and the effect of those properties on volume computation.

A Single Pump Cassette

A single pump cassette 401 will be described below, with reference to FIGS. 4A, 4B, and 4C, which are portions of the same views provided in FIGS. 1A, 1B, and 1C. After describing the operation of a single cassette, we shall examine the use of dual tandem cassettes coupled to a dual pump for regulated volumetric pumping.

In the plan view of FIG. 4A looking down on cassette 401, the innermost concentric circle 410 indicates the outer diameter of the cap of valve "T" 410, shown in section in FIG. 4B. The next circle out, 411, indicates the outermost perimeter of o-ring 411, again seen in section in FIG. 4B. The outermost of the three central concentric circles in FIG. 4A, at 412, represents the cylindrical boundary wall 412 of valve outlet cavity 430, as viewed in FIG. 4B and similarly in FIG. 4C. Bounding 430 from above is cap 435, which mates above cavity 430 with the lower surface of cap 335 of FIG. 3. Thus, AC fluid pressure couples through the mated cap membranes from pump cavity 330 to cassette cavity 430. As seen in FIGS. 4B and 4C, boundary wall 412 extends down and into the outer lower floor of cavity 430. Below o-ring 411, this lower floor angles up to form an outward sloping circular valve seat for o-ring 411. The lower outer surface of the cap of valve "T" 410 forms a second circular valve seat for o-ring 411. From this second valve seat upward and inward, valve 410 forms the floor of cavity 430, creating a normally-closed volume, excepting for an outlet fluid passageway through narrow conduit 444 and broader conduit 442 of FIG. 4C. Even though pumping is accompanied by large AC pressure swings in cavity 430, the high flow inductance arising from the length and small cross-section of conduit 444 prevents significant escape of AC fluid power from cavity 430.

Below outlet chamber cavity 430 is inlet chamber 440, which is seen in FIG. 4C to connect with narrow conduit 443 and larger outer inlet conduit 441. The action of the o-ring valve is apparent from the geometry. When, during an AC pressure cycle, the pressure in cavity 430 falls below that of cavity 440 by enough margin to overcome the radial force bias on o-ring 411, then o-ring 411 expands radially, unseating from one or typically both of the valve seat surfaces and opening a pair of circular slots for fluid flow. By using an o-ring of small cross-section and reasonably large circumference, the inertia to be overcome to open a substantial slot area can be made extremely low. By taking care to keep the fluid path on either side of the valve 410 broad in area and short in flow path length, fluid inertia is minimized and an efficient passive high-frequency valve is accomplished. The cracking pressure of the valve is fine-tuned by twisting valve "T" 410 so that its threaded lower end in female thread 431 of the cassette housing causes valve 410 to move axially. Moving valve 410 down closes the spacing between the sloping valve seats and pushes o-ring 411 to a larger radius, resulting in greater hoop stress and a greater radial force seating the valve. Moving valve 410 up similarly lowers the o-ring preload and the forward cracking pressure.

As with conduit 444 on the fluid outlet, narrow conduit 443 offers vibrational isolation through its fluid inductance. It is necessary, however, to bypass this inductance with a volumetric capacitance (i.e. dVolume/dPressure) in order to achieve rapid fluid acceleration past o-ring 411 during its commonly sub-millisecond open periods. It has been observed that when a comparatively long, narrow fluid column must be set in motion each time a valve opens and fluid flow begins, then flow inertia, or fluid inductance, limits the volumetric acceleration so severely that almost no fluid passes through the valve in an audio-frequency cycle. To permit rapid flow acceleration, a fluid capacitor is needed: a volumetric compliance, that is, something such as, but not limited to a small captured volume of gas isolated from the fluid by a thin membrane, or from a comparatively large volume of gas isolated from the fluid by a comparatively thick membrane. The goal is to have the resiliences, or reciprocal volumetric capacitances, of the gas plus the membrane add up to an appropriate resilience for bypassing fluid inertia over the volume transfer of a single pumping cycle. If the membrane isolating the gas is relatively thin and the gas volume small, then the gas volume dominates in determining resilience. If the membrane is relatively thick, in relation to free span and area, and the gas volume is comparatively large, then the membrane dominates resilience. In the preferred embodiment drawn here, chimneys 451 and 452, terminating into elastomer cap 435 with captured air volumes above cap 435 opposite the chimneys, operate as a volumetric compliance means to provide the desired bypass volumetric capacitance.

Examining the bypass capacitor geometry in more detail, the pathway to the fluid bypass capacitor is shown in FIG. 4B as a horizontal channel extending valve source cavity 440 outward to the left and right into two vertical chimneys, 451 and 452, which extend upward to the elastomer membrane covering of cap 435. As seen in FIG. 4A, the cross-section of these chimneys in plan view is opposite annular arcs, each spanning about 60 degrees angle at full width as drawn, and terminating beyond those angular limits with the width going to zero in semicircular arcs. Referring to FIG. 3, it is seen that chimneys 451 and 452 terminate, through the elastomer surface of cap 435, into annular cavity 340 of the pump, the upper extent of which is set by the lower surface of ring 345. The joining of cavity 340 with chimneys 451 and 452 is seen in FIG. 1B. Comparing this with the orthogonal elevation section of FIG. 1C, it is seen that clamp ring 345 is thicker where it is not above one of chimneys 451 or 452, extending down flush with the lower outer surface of housing piece 106. In fact, the bottom surface of ring 345 is indented with wells with shapes matching chimneys 451 and 452, and alignment tabs (not shown) are provided to align ring 345 rotationally so that its wells will line up with chimneys 451 and 452 when the cassette 401 is clamped to the driver subassembly 201.

Note in FIG. 4B that chimney 451 is filled over most of its vertical extent by plug 454, with a similar plug filling chimney 452. Plug 454 includes vertical conical extensions 453 and 455, extending respectively up and down from the angular centers of the plugs. Extension 453 is visible in FIG. 4A from above as a small circle, whose diameter is the base of the cone. Extensions 453 and 455 are preferably soft elastomer cones, comparable to the rubber tips found on the ends of some toothbrush handles, intended to center plug 454 axially while being compliant enough to allow vertical vibrations of the plug 454 at pumping frequencies—and similarly for the plug opposite plug 454. The two plugs fit with a small perimeter clearance into chimneys 451 and 452, so that they can vibrate freely in a vertical direction. If the plugs matched the specific gravity of the transmission fluid, they would be virtually transparent to vibrations, causing the chimneys 451 and 452 to function almost as if they were fluid filled and the plugs absent. In fact, the plugs are not needed for efficient pumping, and the function of the fluid bypass capacitors can be understood without considering the plugs. Their function is, by choice of their density, to alter the vertical component of mass vibration to null out the high-frequency vibration of the center of mass when a pulse of fluid travels past the o-ring 411.

Dynamic Balancing for Noise Reduction

As previewed earlier, dynamic balancing to prevent external housing vibration and consequent noise generation is achieved in two ways: balancing for fixed center of mass when plate 310 (FIG. 3) is driven to vibrate, and balancing for fixed center of mass when a pulse of fluid flows past o-ring 411 (FIG. 4B). The latter balance is better understood when the former has been described.

A principle to be understood here concerns the relationship of center-of-mass motion to fluid column length and volumetric displacement. Mass displacement is defined as volumetric displacement times density of the displaced fluid. Mass-displacement length is defined as mass displacement multiplied by the length of travel of the fluid center of mass. If a rigid object of mass M is displaced through length X, then mass displacement length is simply M-times-X. Given peak displacement amplitude X at frequency omega, the peak acceleration force to vibrate mass M is simply omega-squared multiplied by mass-displacement length. If a fluid path can be looped so that net mass displacement length is zero, then no external force will be needed to prevent a rigid body containing the internal fluid path from vibrating. It is easily shown that in a straight column of fluid, mass-displacement length equals fluid volume displacement times density times column length. The cross-section of the column does not matter. If the cross-sectional area is large, a large volume of fluid moves slowly; if small, a small volume of fluid moves rapidly. In either case, the mass motion depends only on density, length, and volume displacement. If fluid moves around a closed torroidal path, down through the center of the donut and up around the outer edges, then the mass-displacement length is always zero, independent of the particulars of the inner and outer cross-sections of the fluid path.

Referring to FIG. 1B, if the shafts of drivers 201 and 202 accelerate inward from the left and right, the driver center of mass remains fixed. Linkage sections 152 and 153 will drive the plug 315 and cap 318 assembly and the center of the plate 310 downward. Assume that the cassette valve 410 is closed and offers virtually no volumetric compliance from below, and assume that the fluids in the pump and cassette are not significantly compressible. It follows that fluid displaced by the bottom cap 318 of plug 315 (numbering found in FIG. 3) must come up the cylindrical portion of gap 312 and displace the outer areas of plate 310 upward. Now suppose that plug 315 with its enclosed cavities is less dense than the surrounding transmission fluid. Suppose further that when the masses of the cap parts (158, 159, 160, 305, and part of the mass of the spring strip including 152 and 153) is added to the mass of plug 315 and cap 318, then the total mass divided by the volume of plug 315 and cap 318 below plate 310 equals the density of the fluid displaced by plug 315 and cap 318. For net vertical mass motion, it is then as if all the vertically-moving mass above the plate 310 were removed and the plug below the plate were removed, leaving only plate 310 resting on incompressible fluid. Distortions in the surface of plate 310 will displace fluid down locally and up locally, keeping the vertical axial coordinate of the center of mass fixed. For a constant-thickness plate undergoing vertical distortions at net vertical displacement, as constrained by the fluid below, the plate center of mass does not move. Hence, by appropriate choices of material densities, geometries, and cavity volumes, it is possible to obtain a mass motion balance, allowing the vibration pump to operate without center-of-mass motion. To the extent that the housing can be made rigid at operating frequencies, the surface of the pump can be prevented from vibrating. Other noise-blocking measures such as suspending the coupled pump-cassette against coupling vibrations to a sealed surrounding enclosure are needed only to compensate for small errors in mass balancing and small housing vibrations related to the finite compliance of the housing, which will vibrate locally even as the center-of-mass is kept fixed.

When the valve 410 in cassette 401 opens, the mass balance just described is disrupted. A negative pressure swing from the pump draws a column of fluid upward from cavity 440 (labeled in FIG. 4B) effectively up to the level of the top surface of plate 310, including plate metal mass as well as fluid mass in the center-of-mass motion. The mass balance goal is to complete an effective torus for fluid motion, using the fluid path radially outward and upward to the volumetric bypass capacitor, as described above for speeding fluid acceleration through the valve. One approach to creating an inertial torus would be to complete a fluid path out past the perimeter of plate 310 and then up to a level slightly above the upper surface of plate 310, taking into account the high density of the plate metal. The approach illustrated in this preferred embodiment is to use a much shorter rising outer fluid column and mass-load this column, making plug 454 and its opposite counterpart much denser than the fluids in the cassette and pump. Even if these plugs fit loosely in the fluid columns they are intended to load, they will be accelerated vertically by the fluid accelerating around them, and a plug density can be determined that will achieve a high-frequency mass balance.

Fluid Dynamics Schematic

A schematic representation is provided to understand the multiple energy transformations of this pump, going from electrical to mechanical to fluid energy with tuned components and a non-linear valve. Electronic circuit symbols are more commonly understood than their mechanical and fluid analogs and so are chosen for the entire schematic of FIG. 5. The transformers represent conversions from one to another form of energy. In the three media, an electrical resistor is a mechanical damper is a fluid damper. An electrical inductor is a mass is a fluid inductor. An electrical capacitor is a spring is a volumetric capacitor. Electrical charge Q becomes displacement distance X becomes fluid volume displacement Q. Electrical voltage V becomes force F becomes pressure P. Fluid inductance L, resistance R, and capacitance C are defined so that the energy formulas associated with fluid volume Q and its derivatives with respect to time "t" are the same as for electrical charge Q with the electrical analogues of L, R, and C. Thus, energy E obeys:

1] $E=\frac{1}{2}*L*(dQ/dt)^2$

2] $dE/dt=R*(dQ/dt)^2$

3] $E=\frac{1}{2}*Q^2/C$

4] E=V*Q (electrical)=P*Q (fluid)

The fluid equations of motion then look like the electrical ones, with L, R, and C being defined as with electricity except substituting P for V:

5] $L=P/(d^2Q/dt^2)$

6] R=P/(dQ/dt)

7] C=dQ/dP

It is readily shown that the fluid inductance L at density RHO of a channel of length LGTH and cross-section AREA is:

8] L=RHO*LGTH/AREA

For gas compressing and decompressing adiabatically through small fractional volume changes:

9] C=VOLUME/(GAMMA*ATM) adiabatic where GAMMA is the adiabatic/isothermal heat capacity ratio, about 1.4 for air, and ATM is total atmospheric pressure. The isothermal formula lacks GAMMA:

10] C=VOLUME/ATM isothermal

Textbook formulas for fluid friction are, for the most part, not applicable in determining high-frequency vibrational flow resistance: peak velocities are extremely small, so Reynolds numbers approach zero, but steady-state laminar flow profiles are never approached before a flow reversal. Pressure gradients determine fluid acceleration except in thin boundary layers, whose thickness THK is characterized in relation to density RHO, absolute viscosity MU, and frequency OMEGA by the following formula:

11] THK=SQRT(MU/2*OMEGA*RHO)

This thickness is both a displacement thickness and a dissipation thickness. For example, in a cylindrical channel where THK<<RADIUS, the flow velocity in the center is determined, in relation to volume flow dQ/dt, as if RADIUS were reduced to (RADIUS-THK) for computing the effective flow cross-section. The bulk flow is thus displaced away from the wall by the distance THK. Looking at dissipation thickness, the amount of kinetic energy associated with the cylindrical shell volume between (RADIUS-THK) and RADIUS along the cylinder length, and with the peak velocity of the fluid computed for the center of the channel, that amount of kinetic energy is dissipated once for each time period of one radian, i.e. over period =1/OMEGA. Equivalently, the power dissipation rate is OMEGA times the energy calculated for the volume of the shell between (RADIUS-THK) and RADIUS. The same approach predicts dissipation for flow between parallel plates, e.g. in the fluid layer beneath plate 310.

With these formulas in mind, the dynamics of the current pump system can be understood approximately in relation to FIG. 5, which represents the electrical, mechanical, and fluid aspects of a dual-pump and dual-cassette system for controlled volumetric delivery. The identical interconnected left and right sections are referred to as the left pump/cassette and the right pump/cassette, with the dual pump inlet on the far left at 550, the junction of the left cassette output and right cassette input at 558, and the dual pump outlet on the far right at 559. Following part numbers for the left pump/cassette, which is essentially mirrored by the right pump/cassette, an AC electrical voltage is applied at 510 to drive the system. Resistor 512 and inductor 514 are characteristic of the wired pair of electromagnetic drivers, 201 and 202 of FIGS. 1A and 1B. Transformer 516 interfaces between electrical and mechanical domains. Current "I" on the left-hand electrical side becomes force "F" delivered to the plate 310, taking into account the forces of both drivers 201 and 202 and the mechanical advantage ratio of linkage 151 between horizontal and vertical motion. The vertical velocity dX/dt associated with force "F" is transformed in the reverse direction into a voltage, or back-EMF, "V", reflecting back into the electrical circuit. This back-EMF can be detected directly in the drive windings via an impedance bridge circuit or, advantageously, a similar signal can be detected in a separate set of sense windings, as has been explained. We have for electromechanical transformer constant Kem:

12] F=Kem*I Kem in Newtons/Amp

13] V=Kem*dX/dt Kem in Volts/(Meter/Second)

It is readily shown that the units Newtons/Amp and Volts/(Meter/Second) are identical. If it is not clear that Kem in Eq. 12 must be identical to the Kem in Eq. 13, consider the product of the two equations:

14] Kem*V*I=Kem*F*dX/dt

If Kem is a real number, i.e. free of phase shift, then electrical power V*I becomes an equal amount of mechanical power F*dX/dt, and the two versions of Kem are equal. The traditional model used, successfully, to analyze energy transformers, associates energy losses with separate components on the input and output sides of a transformer but associates no loss with the energy conversion step itself. In the case of sinusoidal currents and voltages at a frequency with the possibility of phase shift, the equality of Kem in Eqs. 12 and 13 is not so obvious, but is in fact proved by the Theorem of Reciprocity, though Kem may be complex valued. The same equality of transformation coefficients applies to the mechanical-to-fluid-energy conversion.

In the mechanical domain, capacitor 520 corresponds to the net spring coefficient experienced through linkage 151 to vertical motion. Inductor 522 is the net moving mass. Both the sum of the moving masses and the sum of the spring coefficients in the two drivers 201 and 202 are transformed by the square of the linkage mechanical advantage ratio.

At the output of the mechanical linkage, force is transformed into pressure, and volume is transformed into displacement, both according to the mechanical-fluid transformer constant Kmf:

15] P=Kmf*F Kmf in Pascals/Newton

16] X=Kmf*Q Kmf in Meters/Meter$^3$

In both instances the dimension of Kmf boils down to 1/Meter$^2$. This coefficient, relating to an effective piston area displacing fluid, is different for static displacements than for fundamental-frequency vibration mode displacements or for the various higher-frequency modes of vibration. The dependence on mode arises from the difference in geometric pattern of the different modes. The fundamental vibration mode, of interest for pumping, entails a distribution of pressures with opposite pressure polarities at the center and perimeter of the disk. The series circuit indicates the opposite-polarity pressure extremes by the potentials on capacitor 530 to ground reference 532 for pressure at the disk perimeter, and on capacitor 538 to ground reference 540 for pressure at the center region where the cassette is coupled. The volumetric spring coefficients on the capacitors are related to the stiffness and shape of plate 310. The arrow through inductor 536 indicates variable inductance, which depends on the net fluid volume under plate 310, and therefore on the average thickness of the fluid layer under the plate 310. We can say that the value of inductor 536 is a function of the sum of the charges stored on 530 and 538, where the resonant alternating component of charge cancels in the sum over 530 and 538. The pressure on 538 is tapped, with an effective series inductance 542 representing inertia in the transfer of volume to the cassette valve 410.

The diagram of FIG. 5 implies that the DC capacitance of the pump as seen from the output side of diode 554 is the parallel combination of capacitors 530 and 538, while the resonant frequency is set by the series combination of capacitors 530 and 538, and the ratio of peak pressure amplitudes at the center and perimeter of the plate is determined by the ratio of capacitor 530 to capacitor 538. This level of scrutiny overconstrains the discrete model, which of course represents a three-dimensional structure. The components shown can be adjusted to represent the resonant frequency, the total oscillatory energy in relation to a pressure amplitude at capacitor 538, and an output impedance in the vicinity of resonance for driving the diode rectifier. In that case, the low frequency compliance of the circuit is not, in general, matched to the sum of capacitors 530 and 538, nor is the ratio of capacitances of capacitor 530 to capacitor 538 indicative of the ratio of dynamic pressures at the center and perimeter of the plate. Within the topology shown, different combinations of component values can correctly represent behaviors corresponding to different measurements, at low frequencies and near resonance. For qualitative discussion, a single set of component values approximates behavior under all conditions. Specifically, capacitor 530 works out to be somewhat larger than 538, so the DC compliance is more than twice the compliance capacitor 538 that is evident, through a small series output inductor 542, in determining the source impedance driving the diode circuit. Another important conclusion is that the source impedance via inductor 542 driving the diode circuit tends to be low compared to the lowest achievable value for inductor 560. This inductor, and diode regurgitation, tend to be the limiting factors for fluid power rectification, with resonant transformer output impedance being negligible.

The cassette valve 410, represented by diode 554, acts much like a real silicon power diode rectifying near its frequency limits. A certain amount of charge must be pumped into a semiconductor diode as its capacitance increases on the way to forward conduction. By analogy, a significant fluid volume displacement must take place simply to move the o-ring out of the way before significant flow around the o-ring can begin. If the voltage reversal on a semiconductor diode is sudden, then there will be a backward current spike as the conduction layer in the junction is discharged. Similarly, a sudden pressure reversal on the o-ring valve will draw a volumetric regurgitation, part of which is a return of the volume displacement that originally moved the o-ring 411 outward, and part of which is actual reverse flow past the o-ring 411, with a closure speed that is limited by inertia. Both the semiconductor and fluid diodes will stop reverse flow successfully only if designed with a significant forward conduction or flow threshold—a few tenths of a volt, or one to three pounds per square inch. A semiconductor diode doped for extremely low forward bias is inherently leaky. In a real o-ring with surface roughness, a minimum force is needed to flatten the irregularities of the rubber surface against the valve seat and make a seal, and this force implies a minimum forward bias pressure to initiate flow above a small leakage value. It appears from computer simulations that an o-ring valve diode with a low forward bias pressure, operated at too high a frequency, and passing a viscous fluid, will actually regurgitate more than it passes in forward conduction, yielding a net reverse flow that increases with AC excitation. Both the semiconductor and fluid diodes exhibit a steeply rising curve of steady flow as a function of steady forward voltage or pressure.

The only significant difference in the diode analogy concerns the relative importance of two effects that limit high-frequency rectification efficiency. Transient reverse current or regurgitation is a significant frequency limiting factor in both electrical and fluid domains, with viscosity playing an important role in fluid regurgitation. Diode inductance, modeled by inductor 560 for the fluid rectifier, is comparable in importance to regurgitation in limiting high frequency pumping. In practice, part of inductor 560 is attributed to the vicinity of the o-ring seats and the maximum slot width when the o-ring is well out of the way, and the remainder of inductor 560 is attributed to the "chimney" path to the volumetric bypass area. The effect of inductor 560 is to slow the acceleration of flow after valve opening and cause flow to continue well after the driving pressure via inductor 542 has fallen below the diode forward bias, and even after the driving pressure has reversed. The diode load begins to exhibit phase lag and a reduced power factor, requiring an increased fluid overpressure to transfer a given amount of pumping power if the inductance of inductor 560 is not kept small enough. The overpressure has an energy cost in raising the dissipation in resistor 534, and it has a cost in possibility of fluid cavitation if an excessive negative pressure swing is required. By contrast, inductance is not typically as important a limiting factor in electrical power rectification.

Inductors 552 and 556 are the intentionally large fluid inductances of channels 443 and 444 (FIG. 4C), being much larger in magnitude than inductor 560, which is kept as small as possible. Inductor 556 prevents AC fluid power from leaking out of the output chamber 430 of the pump, shown in FIG. 4B, while inductor 552 serves a largely acoustic isolation function in keeping relatively small pressure fluctuations away from the inlet fluid line. Raising the design operating frequency ultimately permits a size reduction in plate 310, a desirable objective that is constrained by difficulties in reducing the size of inductor 560 and achieving a fast fluid diode, the two related problems having to do with o-ring and fluid path geometries. The capacitance of capacitor 562 must be large enough that the pressure change over one pumped volume pulse is relatively small compared to the overall driving pressure amplitude via inductor 542. Too low a value for capacitor 562 limits pumping rate and efficiency. Capacitor 562 can be made quite large, the possible cost being a reduction in volume measurement accuracy.

To understand the dynamic relationships involving pump pulses through diode 554, consider a typical driving pressure of 10 psi peak AC amplitude pumping against a static load pressure differential of 4 psi from fluid inlet 550 to outlet point 558, which is common to the output of the first pump and the inlet of the second pump. Assume an o-ring forward cracking pressure of 2 psi. Then fluid flow acceleration cannot begin until the AC pressure has fallen to −6 psi headed for a negative peak of −10, in order to overcome 4+2=6 psi for the load and the o-ring bias. In a typical design pumping at 800 Hz, the volume per cycle might be 2 microliters, which at 800 Hz works out to 1.6 milliliters per second of actual pumping of the first stage. If the capacitance of capacitor 562 is, in convenient units, for example 2 microliters/psi, then a single fluid flow pulse at 2 microliters will drop the pressure on the inlet side of diode 554 by 1 psi. If inductor 552 is sufficiently large that the natural frequency of inductor 552 resonating against capacitor 562 is well below the 800 Hz pumping frequency, say below 200 Hz, then the pressure waveform on capacitor 562 will resemble a sawtooth, starting at about 0.5 psi below the source pressure at inlet 550, swinging about 0.5 psi above that source pressure, and then getting yanked back down during the relatively brief flow conduction pulse of diode 554. This sawtooth waveform tends to promote earlier valve opening and earlier valve closing, which can minimize phase lag and improve the power factor for rectification. If capacitor 562 is made too small, the rectification power factor becomes worse on the phase-lead side and the impedance of capacitor 562 dominates in limiting volume per stroke.

Two-Stage Volume Servo Pumping

Having explained single-stage pumping operation, we examine two-stage volume-controlled pumping in relation to the left and right sections of FIG. 5. Component numbers on the left are raised by 1 to give comparable component numbers on the right, with the exception of junction 558, which is common to the output of the left pump/cassette and the input of the right pump/cassette, leading via the cassette to the system output at 559. It is seen that load pressure at 559 is communicated into the resonant fluid power transformer, placing a volume bias on capacitors 531 and 539. An increased output pressure reduces the inductance of inductor 537 and, through nonlinear bending effects, can reduce slightly the dynamic values of capacitors 531 and 539. The effect of both these changes is to raise the resonant frequency, which can be calibrated against both volume and pressure. Hence, the system inherently measures output load pressure. Similarly, the resonance of the left pump indicates the inter-stage pressure at junction 558 and the net volume stored in the inter-stage. Part of the inter-stage volume swing occurs in left pump resonator capacitors 530 and 538, with the remainder occurring in decoupling capacitor 563 of the right cassette. If the relationship between volume in these capacitors to resonant frequency in the left pump is calibrated or known by reproducible manufacture and reference to calibration of a typical pump, then it is possible to obtain tight control of volumetric delivery. With sufficient forward cracking bias pressures on diodes 554 and 555, there will be a pressure and volume range for the interstage over which both diodes are closed in the absence of pump excitation. The measurement sequence, as described earlier, is then simply to pump fluid in from the left pump, stopping before diode 555 opens, then measure volume by low-level excitation and phase measurement of the left pump to determine resonant frequency and volume, then pump fluid out of the interstage via the right pump, stopping before diode 554 opens, and finally remeasure volume of the interstage to determine the volume that was delivered to the output. This sequence can be repeated to provide a train of measured flow pulses to the output, operating each pump at a duty cycle below 50% to allow time for the frequency measurements between pumping periods.

Continuing the numerical example from above, if the net pump volume compliance at DC is 8 microliters/psi, added to 2 microliters/psi of bypass capacitor 563 for a net interstage capacitance of 10, and allowing a 3 psi peak-to-peak pressure swing, that implies 30 microliters per pump/measure cycle, which at 2 microliters per stroke at 800 Hz implies about 15 cycles of pumping, or 17 cycles of excitation (allowing for oscillation buildup), requiring about 21 milliseconds. Settling and frequency measurement could take an additional 19 milliseconds, yielding a total of 40 milliseconds for inputting fluid and measuring, and another 40 milliseconds to output fluid and remeasure. The overall servo-pumping rate is then 30 microliters per 80 milliseconds, or 0.375 microliters/millisecond =1.35 liters/hour. By reducing the pumping pulse volume down to an easily resolved 5 microliters and stretching the pulse period from 80 milliseconds to 15 seconds, one achieves a delivery rate of 1.2 milliliters/hour with decent flow continuity for infusion purposes. The volumetric output compliance at 559 is just 8 microliters/psi, considerably lower than common intravenous tube sets and providing a desirable "stiff" volumetric delivery to maintain flow continuity at low rates.

Patency and Bubble Checks

The system schematized in FIG. 5 provides ways to infer inlet source pressure at 550. One approach is to provide for electronic control of the AC excitation amplitude at source 510 or, if amplitude is fixed by the hardware, to provide for excitation purposely off the center resonance. The referenced Measurement System Application presents specific approaches for measuring phase versus frequency responses in the drive circuit and thereby determining the center-resonance and bandwidth for the fluid transformer. The non-pumping output pressure of the transformer can be reduced to a known level by control of either the frequency or amplitude of electrical excitation at source 510. In the presence of pumping, power transfer to the diode circuit can typically double the damping factor observed in the resonant transformer, with damping being strongly dependent on excitation amplitude. An input pressure estimation approach would therefore be to intentionally lower the pressure amplitude to diode 554, seeking a maximum amplitude threshold where a power pulse yields no volume change and indicating that pumping-related damping has not affected actual damping and peak pressure during the test. A knowledge of the forward pressure bias preset in diode 554, combined with an AC threshold amplitude and a bias pressure of the interstage, then yields an estimate of absolute source pressure. Hence, an infusion pump based on the current invention can check the patency of its fluid source and sink.

Detecting bubbles in the pump is readily understood in relation to FIG. 5. If a bubble comes through diode 554 and lodges in chamber 430 (FIG. 4B), i.e. at the junction of 554, 556, and 542, that bubble volume will behave like a capacitor according to Eqs. 9 and 10, the relative degree of adiabatic versus isothermal behavior being determined by bubble size in relation to frequency and thermal diffusivity (an issue beyond the scope of discussion here but involving a thermal boundary layer formula closely analogous to Eq. 11.) Large bubbles will exhibit self-resonance due to inertia of fluid around the bubble, but bubbles below 20 microliters or so will generally behave as simple capacitors at typical pump frequencies. A capacitor at the junction just described will alter the resonant circuit qualitatively, adding a new LC resonance due to inductor 542 and splitting the fundamental resonance of the resonator involving inductor 536. The most readily apparent indication of bubble entry will be an abrupt shift in apparent fundamental resonance frequency and apparent volume, not explained by the pattern of previous volume changes associated with pumping pulses. To investigate the anomaly and confirm whether a bubble is involved, the phase-versus-frequency response of the pump is measurable by methods discussed primarily in the referenced Measurement System Application. The phase/frequency patterns characteristic of various bubble sizes are readily computed based on the schematic of FIG. 5, with appropriate component values determined for a real pump/cassette. Bubble identification and approximate quantification thus becomes a matter of pattern recognition, comparing measured and computed phase/frequency graphs seeking a computed bubble size that provides a best fit to measured data.

Small bubbles that enter a dual pump/cassette system can be flushed through to the output side, observed emerging through diode 555 as an affect on the second resonator section, and pumped downstream. Limits can be set on pumped air, triggering operator alarms, etc. A system with bubble quantification capability can be programmed to minimize nuisance alarms from inconsequential bubbles. Large bubbles will so effectively decouple the outlet sides of the diodes from the AC pressure source that pumping cannot be sustained and the pump will require manual purging. This system cannot pump air, even in the event of catastrophic software failure.

Although the preferred embodiment of the present invention has been described above, the description is merely illustrative of an approach to fluid pumping and volumetric control, with design variations meeting varying application constraints. An obvious variation is to design for coupling the vibrating plate directly to the fluid to be pumped for developing dynamic pressure oscillations, rather than deriving pressure in a "working" fluid and then coupling the pressure to a separate "deliverable" fluid. The two-fluid approach is advantageous with a non-disposable "pump" coupling to multiple disposable "cassettes" for which size is to be minimized and for which ease of purging and debubbling is to be maximized. The vibrating plate can then be larger in diameter than the cassette, and the pressure-developing pump geometry need only be purged once or infrequently, leaving cassette purging as a separate and simpler engineering problem. Considering a one-fluid approach, however, one has a simpler if less compact design and the opportunity to purge the entire system via the inlet and outlet pathways used for fluid delivery. A starting point for the geometry of a one-fluid pump design is provided by FIGS. 8A and 8B of the referenced Measurement System Application, which illustrate a one-fluid device for measuring volume displacement and fluid properties. In the cassette side shown separately in FIG. 8A, close off inlet passageway 825 and substitute a lower inlet fluid path into an inlet chamber and the inner surface of a valving o-ring, e.g., as illustrated in FIG. 4C of the present application by fluid inlet 441 and restricted inductive path 443 leading into chamber 440 at the check valve inlet side. Outlet chamber 430, as shown in FIG. 4B, is expanded to resemble chamber 806 of FIG. 8A in the referenced Measurement System Application except for having a central well where the check valve resides. With this geometry, the inertial bypass "chimneys" of FIG. 4B must be moved to the outside of the enlarged central interface region, or alternatively, a bypass compliance volume can be provided somewhere else with the cassette geometry.

As indicated earlier, multiple combinations of electromechanical drivers and sensors are applicable to the present invention, as are a multiplicity of fluid path geometries. All such variations are deemed to be within the scope of the invention as defined by the appended claims.

I claim:

1. A method for conveying a deliverable liquid from one location to another comprising the steps of:

a. transforming oscillatory electrical power at a resonant frequency into oscillatory mechanical force;

b. transforming in a fluid-delivery device having a compliant element coupled to said deliverable liquid said oscillatory mechanical force into resonant motion of the combination of said deliverable liquid and said compliant element so as to produce oscillatory motion of said deliverable liquid;

c. confining said deliverable liquid such that said oscillatory motion of said deliverable liquid and inertia of said deliverable liquid generate a deliverable-liquid oscillatory pressure; and d. converting said deliverable-liquid oscillatory pressure into one-way motion of said deliverable liquid from one location to another.

2. The method as claimed in claim 1 wherein the step of transforming said oscillatory electrical power into oscillatory mechanical fares includes the step of coupling said oscillatory electrical power to a transducer assembly having a transducer element couplable to said fluid-delivery device.

3. The method as claimed in claim 2 further comprising the step of coupling said transducer element to a linkage assembly component such that oscillatory linkage assembly of said mechanical-motion component imparts said oscillatory pressure to said deliverable liquid.

4. The method as claimed in claim 3 further comprising the step of mechanically coupling but physically isolating a working liquid to said deliverable liquid.

5. The method as claimed in claim 4 wherein the step of physically isolating said working liquid from said deliverable liquid includes the step of placing one or more membranes between said working liquid and said deliverable liquid.

6. The method as claimed in claim 2 further comprising the step of providing as part of said fluid-delivery device a check valve for regulating the flow of said deliverable liquid as a function of said deliverable-liquid oscillatory pressure.

7. The method as claimed in claim 6 further comprising the step of providing inertial bypassing in said fluid-delivery device so as to facilitate rapid deceleration and acceleration of said deliverable liquid at high frequencies of deliverable-liquid oscillatory pressure.

8. The method as claimed in claim 6 further comprising the step of maintaining an essentially fixed dynamic center of mass within a cavity of said fluid-delivery device so as to minimize noise generation.

9. The method as claimed in claim 6 further comprising the steps of sensing motion of said transducer element and determining characteristics of said deliverable liquid.

10. The method as claimed in claim 9 wherein the step of determining characteristics of said deliverable liquid includes the step of coupling said transducer element to computation means.

11. The method as claimed in claim 2 further comprising the step of coupling said transducer element to control means for regulating the delivery of said deliverable liquid.

12. The method as claimed in claim 2 wherein the step of transforming said oscillatory mechanical motion into said resonant motion of said deliverable liquid includes the steps of:

a. measuring a driving force applied to said transducer assembly in order to generate said oscillatory mechanical force;

b. sensing a responsive velocity of said transducer assembly; and c. adjusting a frequency of said oscillatory electrical signal such that said driving force and said responsive velocity are in phase so as to produce a resonant frequency of motion of said transducer assembly, wherein said resonant frequency of motion of said transducer assembly is transferable to the combination of said compliant element and said deliverable liquid for resonant motion thereof.

13. A device for conveying a deliverable liquid from one location to another, said device comprising:

a. a transducer assembly for receiving an oscillatory electrical signal and transforming said oscillatory electrical signal into a corresponding oscillatory mechanical force;

b. a resonant transformer assembly having a compliant element, wherein said resonant transformer assembly is connected to said transducer assembly and said compliant element is coupled to said deliverable liquid, said resonant transformer assembly for transforming said oscillatory mechanical force into a resonant motion of the combination of said deliverable liquid and said compliant element that includes oscillatory motion of said deliverable liquid;

c. fluid path confinement means for confining said deliverable liquid such that said oscillatory motion of said deliverable liquid and inertia of said deliverable liquid create a deliverable-liquid oscillatory pressure and;

d. single-valve means for converting said deliverable-liquid-oscillatory pressure into conveyance of said deliverable liquid in one direction from one location to another.

14. The device as claimed in claim 13 wherein said transducer assembly includes a pair of opposing driver subassemblies each comprising a transducer couplable to an oscillatory electric power supply, wherein each of said transducers is coupled to a linkage assembly, with said linkage assembly connected to said resonant transformer assembly.

15. The device as claimed in claim 14 wherein one or more of said transducers includes sensing means for determining the movement of said deliverable liquid.

16. The device as claimed in claim 15 wherein one or more of said transducers is coupled to control feedback means for regulating drive intervals and power levels of said linkage-assembly.

17. The device as claimed in claim 16 further comprising computation means coupled to one or more of said transducers for evaluating mechanical characteristics of said deliverable liquid.

18. The device as claimed in claim 15 wherein each of said transducers includes a hollow magnetic element, driver windings and sense windings positioned about said magnetic element, and wherein said mechanical-motion component is coupled to a core rod mounted within the center of said magnetic element and coaxial with said magnetic element.

19. The device as claimed in claim 14 with said transducer assembly further comprising spring strips coupled to each of said transducers.

20. The device as claimed in claim 19 wherein said spring strips are formed with preload curvature so as to linearize the compliance of said spring strips with respect to axial motion of said transducers.

21. The device as claimed in claim 14 wherein said mechanical-motion component is a spring band linking each of said one or more transducers to said resonant transformer assembly.

22. The device as claimed in claim 21 wherein said spring band is a V-shaped metal band having:

a. a first end connected to a first transducer of said pair of driver subassemblies;

b. a second end connected to a second transducer of said pair of driver subassemblies; and c. a middle region connected to said resonant transformer assembly, said middle region forming the bottom of the V of said V-shaped metal band.

23. The device as claimed in claim 13 wherein said resonant transformer assembly includes a resonator plate coupled to said transducer assembly and to said deliverable liquid.

24. The device as claimed in claim 23 with said resonant transformer assembly further comprising:

a. an isolated working liquid positioned in a cavity of said resonant transformer assembly, wherein said working liquid couples said resonator plate to said deliverable liquid; and b. means for capturing said working liquid within said cavity of said resonant transformer assembly, wherein said means for capturing said working liquid and said resonator plate constitute the boundaries for said cavity.

25. The device as claimed in claim 24 wherein said means for capturing said working liquid includes a membrane.

26. The device as claimed in claim 25 with said resonant transformer assembly further comprising a plug located within said cavity, wherein said plug is coupled to said resonator plate and coupled to said membrane via said working liquid.

27. The device as claimed in claim 26 wherein said plug is designed with an average density substantially less than that of said working liquid.

28. The device as claimed in claim 23 wherein said resonator plate includes an annular ridge.

29. The device as claimed in claim 13 wherein said fluid path confinement means and said single-valve means are included in a cassette having a deliverable-liquid pathway.

30. The device as claimed in claim 29 with said cassette comprising a cassette cavity forming a portion of said first fluid pathway.

31. The device as claimed in claim 30 wherein said cassette cavity is toroidal.

32. The device as claimed in claim 30 wherein said cassette includes a cassette membrane for isolating said deliverable liquid within said cassette cavity from said resonant transformer assembly.

33. The device as claimed in claim 30 with said cassette further comprising a cassette check valve contained within said cassette cavity.

34. The device as claimed in claim 33 with said cassette further comprising means for regulating the flow of said deliverable liquid, said means comprising:

a. a housing;

b. an inlet port coupled to an inner cavity within said housing, said inlet for receiving said deliverable liquid from a source;

c. an outlet port coupled to an outer cavity within said housing, said outlet for transmitting said deliverable liquid to a sink;

d. an annular gap connecting said inner cavity to said outer cavity; and e. an o-ring within said outer cavity and covering said annular gap, wherein said o-ring is positioned so that when fluid pressure within said inner cavity exceeds pressure within said outer cavity by a first value, said o-ring is forced to expand radially so as to open said annular gap, thereby permitting flow of said deliverable liquid from said inner cavity to said outer cavity, and wherein when said fluid pressure within said outer cavity exceeds pressure within said inner cavity by a second value, said o-ring relaxes to seal said annular gap, thereby preventing flow of said deliverable liquid between said inner cavity and said outer cavity.

35. The device as claimed in claim 34 with said means for regulating the flow of said deliverable liquid further comprising volumetric compliance means coupled to said inner cavity and couplable to said deliverable liquid.

36. The device as claimed in claim 13 wherein said single-valve means includes volumetric compliance means designed to reduce the effect of inertia in conveying said deliverable liquid in one direction from one location to another.

37. The device as claimed in claim 36 wherein said volumetric compliance means is an air pocket separable from said deliverable liquid by an elastomeric sheet.

38. The device as claimed in claim 13 further comprising control means for adjusting a frequency of said oscillatory electrical signal such that a driving force applied by said oscillatory electrical signal to said transducer assembly and a responsive velocity associated with said compliant element are in phase.

39. A system for conveying a deliverable fluid from a source to a sink, said system functioning as a generator of oscillatory fluid pressure and as a self-measuring volumetric reservoir, said system comprising:

a. an electromechanical driver/sensor assembly;

b. a resonant fluid cavity for receiving said deliverable fluid and coupled to said electromechanical driver/sensor assembly, wherein said electromechanical driver/sensor assembly is designed to generate in said resonant fluid cavity a deliverable-fluid oscillatory pressure;

c. means coupled to said electromechanical driver/sensor assembly, said means for electrically energizing said electromechanical driver/sensor assembly at a resonance of said resonant fluid cavity; and d. fluid path confinement means for confining said deliverable fluid such that oscillatory motion of said deliverable fluid and inertia of said deliverable fluid create said deliverable-fluid oscillatory pressure.

40. The system as claimed in claim 39 further comprising:

a. a second electromechanical driver/sensor assembly;

b. a second resonant fluid cavity coupled to said second electromechanical driver/sensor assembly and to said resonant cavity;

c. a second means coupled to said second electromechanical driver/sensor assembly, said second means for electrically energizing said second electromechanical driver/sensor assembly at a resonance of said second resonant fluid cavity; and d. computation means coupled to said electromechanical driver/sensor assembly and to said second electromechanical driver/sensor assembly, said computation means for alternating pumping from said source, with measurement of said deliverable fluid in said resonant fluid cavity providing an indication of volume increases drawn from said source and volume decreases from said resonant fluid cavity to said second resonant cavity such that the sum of volumes drawn from said source provides a measured fluid volume.

41. The system as claimed in claim 40 further comprising means to control the pumping from said source and from said connection means in response to said measured fluid volume such that a net volume drawn from said source as a function of time is controlled.

42. A device for transforming a first motion into a second motion, wherein the direction of said second motion is at a right angle to the direction of said first motion, said device comprising:

a. a first driver subassembly and a second driver subassembly forming a pair of opposing driver subassemblies, wherein each of said driver subassemblies is couplable to a power supply; and b. a linkage assembly having a first end connected to said first driver subassembly and a second end connected to said second driver subassembly, wherein said linkage assembly is designed with a middle region that moves in the direction of said second motion when said first end and said second end of said linkage assembly are driven in the direction of said first motion by operation of said pair of opposing driver subassemblies, wherein each of said driver subassemblies includes a transducer, wherein each of said transducers includes a hollow electromagnetic element, driver windings and sense windings positioned about said electromagnetic element, and wherein said linkage assembly component is coupled to a core rod mounted within the center of said electromagnetic element and coaxial with said electromagnetic element, and wherein said linkage assembly component is a V-shaped metal band with the bottom of the V of said V-shaped band forming said middle region of said linkage assembly, wherein said middle region is couplable to an element to be moved in the direction of said second motion.

* * * * *